US010851484B2

(12) United States Patent
Amos et al.

(10) Patent No.: US 10,851,484 B2
(45) Date of Patent: Dec. 1, 2020

(54) PATTERNED TUFTED ARTICLES, AND SYSTEMS AND METHODS FOR MAKING SAME

(71) Applicant: COLUMBIA INSURANCE COMPANY, Omaha, NE (US)

(72) Inventors: Kim K. Amos, Tunnel Hill, GA (US); Shannon Crump Cochran, Cartersville, GA (US); Neil Vaughan, Rydal, GA (US)

(73) Assignee: COLUMBIA INSURANCE COMPANY, Omaha, NE (US)

( * ) Notice: Subject to any disclaimer, the term of this patent is extended or adjusted under 35 U.S.C. 154(b) by 295 days.

(21) Appl. No.: 15/618,800

(22) Filed: Jun. 9, 2017

(65) Prior Publication Data

US 2017/0356113 A1 Dec. 14, 2017

Related U.S. Application Data

(60) Provisional application No. 62/347,978, filed on Jun. 9, 2016.

(51) Int. Cl.

| | |
|---|---|
| ***D05C 17/02*** | (2006.01) |
| ***D05C 15/32*** | (2006.01) |
| ***D05C 15/36*** | (2006.01) |

(52) U.S. Cl.

CPC ..... *D05C 17/026* (2013.01); *D05C 15/32* (2013.01); *D05C 15/36* (2013.01)

(58) Field of Classification Search

USPC ..... 428/17, 86, 92

See application file for complete search history.

(56) References Cited

U.S. PATENT DOCUMENTS 2,860,669 A * 11/1958 Moberg ..... D03D 27/06 139/402

2,884,881 A 5/1959 Oberholtzer (Continued)

FOREIGN PATENT DOCUMENTS

| | | |
|---|---|---|
| CA | 2202161 A1 | 5/1996 |
| EP | 3161201 A1 | 5/2017 |

(Continued)

OTHER PUBLICATIONS

International Search Report and Written Opinion dated Oct. 18, 2017 by the International Searching Authority for Patent Application No. PCT/US2017/036779, which was filed on Jun. 9, 2017 and published as WO 2017/214520 on Dec. 14, 2017 (Inventor—Amos et al.; Applicant—Shaw Industries Group, Inc.; (15 pages).

(Continued)

*Primary Examiner* — Lynda Salvatore

(74) *Attorney, Agent, or Firm* — Ballard Spahr LLP

(57) ABSTRACT

A tufted article having a backing material and a plurality of tufts. The plurality of tufts can include cut tufts having first and second tuft portions projecting from a face surface of the backing material. The first and second tuft portions of each cut tuft have respective pile heights relative to the backing material. Each cut tuft also has a backstitch that joins the first and second tuft portions and extends across a portion of a back surface of the backing material. The plurality of tufts includes a plurality of asymmetric cut tufts that have first and second tuft portions with unequal pile heights. Systems and methods for making tufted articles having asymmetric cut tufts are also disclosed.

21 Claims, 16 Drawing Sheets

(56) References Cited

U.S. PATENT DOCUMENTS

| | | | | |
|---|---|---|---|---|
| 3,170,493 | A * | 2/1965 | Hoffman | D03D 39/00 139/403 |
| 3,184,367 | A | 5/1965 | White | |
| 3,217,675 | A | 11/1965 | Short | |
| 3,332,379 | A | 7/1967 | Cobble | |
| 3,341,386 | A | 9/1967 | White | |
| 3,386,403 | A | 6/1968 | Short | |
| 3,430,590 | A | 3/1969 | Looper | |
| 3,677,206 | A | 7/1972 | MacIsaac, Jr. et al. | |
| 3,722,442 | A | 3/1973 | MacIsaac, Jr. et al. | |
| 3,881,432 | A | 5/1975 | Dodd et al. | |
| 3,986,465 | A | 10/1976 | Smith et al. | |
| 4,048,930 | A | 9/1977 | Card | |
| 4,062,308 | A | 12/1977 | Spanel et al. | |
| 4,439,476 | A | 3/1984 | Guild | |
| 4,678,533 | A | 7/1987 | Bartlett et al. | |
| 4,808,459 | A | 2/1989 | Smith et al. | |
| 4,867,080 | A | 9/1989 | Taylor et al. | |
| 4,947,528 | A | 8/1990 | Dischler | |
| 4,991,523 | A | 2/1991 | Ingram | |
| 5,158,027 | A | 10/1992 | Ingram | |
| 5,165,352 | A | 11/1992 | Ingram | |
| 5,536,551 | A | 7/1996 | Woosley | |
| 5,562,056 | A | 10/1996 | Christman, Jr. | |
| 5,588,383 | A | 12/1996 | Davis et al. | |
| 6,293,211 | B1 | 9/2001 | Samilo | |
| 6,381,818 | B1 | 5/2002 | Freeman et al. | |
| 7,347,151 | B1 | 3/2008 | Johnston et al. | |
| 7,831,331 | B1 | 11/2010 | Samilo | |
| 8,181,585 | B1 | 5/2012 | Samilo et al. | |
| 8,359,989 | B2 | 1/2013 | Hall et al. | |
| 8,443,743 | B2 | 5/2013 | Christman, Jr. | |
| 8,770,122 | B2 | 7/2014 | Vaughan et al. | |
| 2004/0079468 | A1 | 4/2004 | Reisdorf et al. | |
| 2009/0220728 | A1 | 9/2009 | Hall et al. | |
| 2010/0000623 | A1 | 1/2010 | Makida | |
| 2014/0283724 | A1 | 9/2014 | Frost et al. | |

FOREIGN PATENT DOCUMENTS

| | | | |
|---|---|---|---|
| EP | 3175029 | A1 | 6/2017 |
| GB | 1039857 | A | 8/1966 |
| WO | WO-2015/200816 | A1 | 12/2015 |
| WO | WO-2016/019282 | A1 | 2/2016 |

OTHER PUBLICATIONS

Chen, G.F. et al. (2011) Yarn Feeding Compensation Algorithm and Implementation for Needlebar Transverse Shifting of Carpet Tufting Machine. Adv Mat Res. 179-80:150-5.

High Cut & Low Loop Jacquard Tufting Machine, Dayang, Carpet Machinery, dayangcm.com, accessed: Mar. 2016. http://www.dayangcm.com/english/product/product_show/PACASHCLL.

* cited by examiner

PATTERNED TUFTED ARTICLES, AND SYSTEMS AND METHODS FOR MAKING SAME

CROSS-REFERENCE TO RELATED PATENT APPLICATION

This application claims priority to and the benefit of the filing date of U.S. Provisional Patent Application No. 62/347,978, filed Jun. 9, 2016, which application is incorporated herein by reference in its entirety.

FIELD

This disclosure relates to patterned tufted articles having asymmetric tufts and to systems and methods for making such tufted articles.

BACKGROUND

During conventional cut pile tufting operations, loops of yarn are sequentially disposed through a backing material, and a cutting assembly cuts the sequentially disposed loops of yarn to form cut tufts with first and second tuft portions that are joined by a backstitch. Conventionally, these cut tufts are cut in a manner that is intended to produce first and second tuft portions having substantially equal pile heights, and any variation in pile height among the two tuft portions is viewed as undesirable. Such variations in pile height are eliminated through the use of shearing and other cutting operations that produce first and second tuft portions having substantially equal pile heights.

Conventionally, variations in pile height among cut pile tufts have been achieved by varying the distance between the backing material or bedplate and the location where loops of yarn are cut to form the cut pile tufts. However, there are many tufting machines that employ a fixed distance between the tuft cutting location and the backing material or bedplate. Thus, there is a need for systems and methods that achieve desired variations in pile height without adjustment of the distance between the tuft cutting location and the backing material or bedplate.

SUMMARY

Described herein are tufted articles having a backing material and a plurality of tufts. The backing material can have a face surface and an opposed back surface. Each tuft of the plurality of tufts can have first and second tuft portions projecting from the face surface of the backing material. The first and second tuft portions can have respective pile heights relative to the face surface of the backing material. Each tuft of the plurality of tufts also has a backstitch that joins the first and second tuft portions and extends across a portion of the back surface of the backing material. The plurality of tufts can include a plurality of asymmetric tufts that have first and second tuft portions with unequal pile heights as further disclosed herein.

Also described herein is a system for controlling the tufting of a patterned tufted article. The system can include a bed plate configured to support a backing material; a roll assembly configured to drive movement of the backing material; a hollow needle having an inlet and an outlet; a yarn feed assembly; a needle actuation assembly; a cutting assembly; and at least one processor. The yarn feed assembly can have an inlet and an outlet positioned in communication with the inlet of the hollow needle, and the yarn feed assembly can be configured to direct yarn to the hollow needle during a yarn feed cycle. The needle actuation assembly can be configured to drive sequential strokes of reciprocal movement of the hollow needle relative to a tufting axis to penetrate the backing material and position sequential tufts of yarn through the backing material. The needle actuation assembly can have a main shaft coupled to the hollow needle such that rotational movement of the main shaft imparts corresponding reciprocal movement of the hollow needle. The cutting assembly can be configured to cut the sequential tufts of yarns to form first and second tuft portions of each tuft that project from a face surface of the backing material and are joined by a backstitch of the tuft. The cutting assembly can be configured to cut the sequential tufts of yarn at a fixed cutting location to produce a second tuft portion of a tuft and define a start of a first tuft portion of the next sequential tuft. The distance between the fixed cutting location and the bed plate relative to the tufting axis is fixed during tufting. The at least one processor can be communicatively coupled to the yarn feed assembly and the cutting assembly. During at least one selected stroke of the needle actuation assembly, the at least one processor can be configured to: (i) selectively direct the cutting assembly to effect cutting of a tuft formed by the hollow needle at a selected cut time, wherein the selected cut time corresponds to a first selected rotational position of the main shaft; and (ii) selectively activate the yarn feed assembly during a corresponding yarn feed cycle to deliver selected percentages of a yarn feed before and after the selected cut time to thereby produce a second tuft portion having a pile height that is different than a pile height of the first tuft portion of the tuft.

Further disclosed is a method for controlling the tufting of a patterned tufted article. The method can include supporting a backing material on a bed plate. The method can also include using a yarn feed assembly to direct yarn to a hollow needle during a yarn feed cycle. The yarn feed assembly can be communicatively coupled to at least one processor. The method can further include using a needle actuation assembly to drive sequential strokes of reciprocal movement of the hollow needle relative to a tufting axis to penetrate the backing material and position sequential tufts of yarn within the backing material. The needle actuation assembly can include a main shaft that is coupled to the hollow needle such that rotational movement of the main shaft imparts corresponding reciprocal movement of the hollow needle. The method can further include using a cutting assembly to cut the sequential tufts of yarn to form first and second tuft portions of each tuft that project from the face surface of the backing material and are joined by a backstitch of the tuft. The cutting assembly can be communicatively coupled to the at least one processor. The cutting assembly can cut the sequential tufts of yarn at a fixed cutting location to produce a second tuft portion of a tuft and define a start of a first tuft portion of the next sequential tuft. The distance between the fixed cutting location and the bed plate relative to the tufting axis is fixed during tufting. During at least one selected stroke of the needle actuation assembly, the method can further include using the at least one processor to: (i) direct the cutting assembly to effect cutting of a tuft formed by the hollow needle at a selected cut time that corresponds to a first selected rotational position of the main shaft; and (ii) selectively activate the yarn feed assembly during a corresponding yarn feed cycle to deliver selected percentages of a yarn feed before and after the selected cut time to thereby produce a second tuft portion having a pile height that is different than a pile height of the first tuft portion of the tuft.

Additional advantages of the invention will be set forth in part in the description which follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DETAILED DESCRIPTION OF THE FIGURES

These and other features of the preferred embodiments of the invention will become more apparent in the detailed description in which reference is made to the appended drawings wherein:

FIGS. 1-1C are cross-sectional diagrams depicting exemplary configurations of tufted articles as disclosed herein. As shown, the tufted articles depicted in FIGS. 1-1C include cut tufts having first tuft portions that extend beyond a cut plane and have a greater pile height than corresponding second tuft portions of the tufts. FIG. 1 depicts a tufted article having a plurality of symmetrical tufts with a single pile height and a plurality of asymmetric tufts that have first tuft portions with a first pile height and second tuft portions with a second pile height substantially equal to the pile height of the symmetrical tufts. FIG. 1B depicts a tufted article having symmetrical tufts and multiple asymmetric tuft configurations (with the first tuft portions of some of the asymmetric tufts having a pile height different than the pile height of the first tuft portions of other asymmetric tufts). FIG. 1C depicts a tufted article having symmetrical cut tufts, multiple asymmetric cut tuft configurations, and multiple loop tuft configurations.

FIGS. 2-2C are cross-sectional diagrams depicting exemplary configurations of tufted articles as disclosed herein. As shown, the tufted articles depicted in FIGS. 2-2C include cut tufts having second tuft portions that extend beyond a cut plane and have a greater pile height than corresponding first tuft portions of the tufts. FIG. 2 depicts a tufted article having a plurality of symmetrical tufts with a single pile height and a plurality of asymmetric tufts that have second tuft portions with a second pile height and first tuft portions with a first pile height substantially equal to the pile height of the symmetrical tufts. FIG. 2B depicts a tufted article having symmetrical tufts and multiple asymmetric tuft configurations (with the second tuft portions of some of the asymmetric tufts having a pile height different than the pile height of the second tuft portions of other asymmetric tufts). FIG. 2C depicts a tufted article having symmetrical cut tufts, multiple asymmetric cut tuft configurations, and multiple loop tuft configurations.

FIGS. 3-3C are cross-sectional diagrams depicting exemplary configurations of tufted articles as disclosed herein. As shown, the tufted articles depicted in FIGS. 3-3C include cut tufts having first tuft portions that extend beyond a cut plane and have a greater pile height than corresponding second tuft portions of the tufts. FIG. 3 depicts a tufted article having a plurality of symmetrical tufts with a single pile height and a plurality of asymmetric tufts that have first tuft portions with a first pile height and second tuft portions with a second pile height substantially equal to the pile height of the symmetrical tufts. FIG. 3B depicts a tufted article having symmetrical tufts and multiple asymmetric tuft configurations (with the first tuft portions of some of the asymmetric tufts having a pile height different than the pile height of the first tuft portions of other asymmetric tufts). FIG. 3C depicts a tufted article having symmetrical cut tufts, multiple asymmetric cut tuft configurations, and multiple loop tuft configurations.

DETAILED DESCRIPTION

Figure 1:
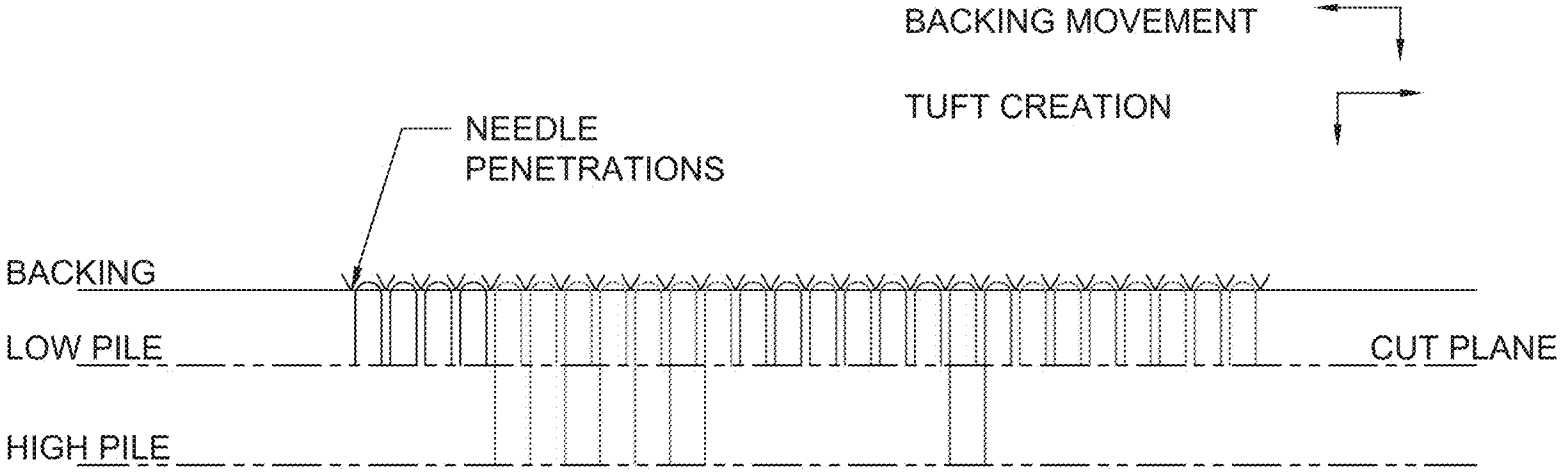
Figure 1B:
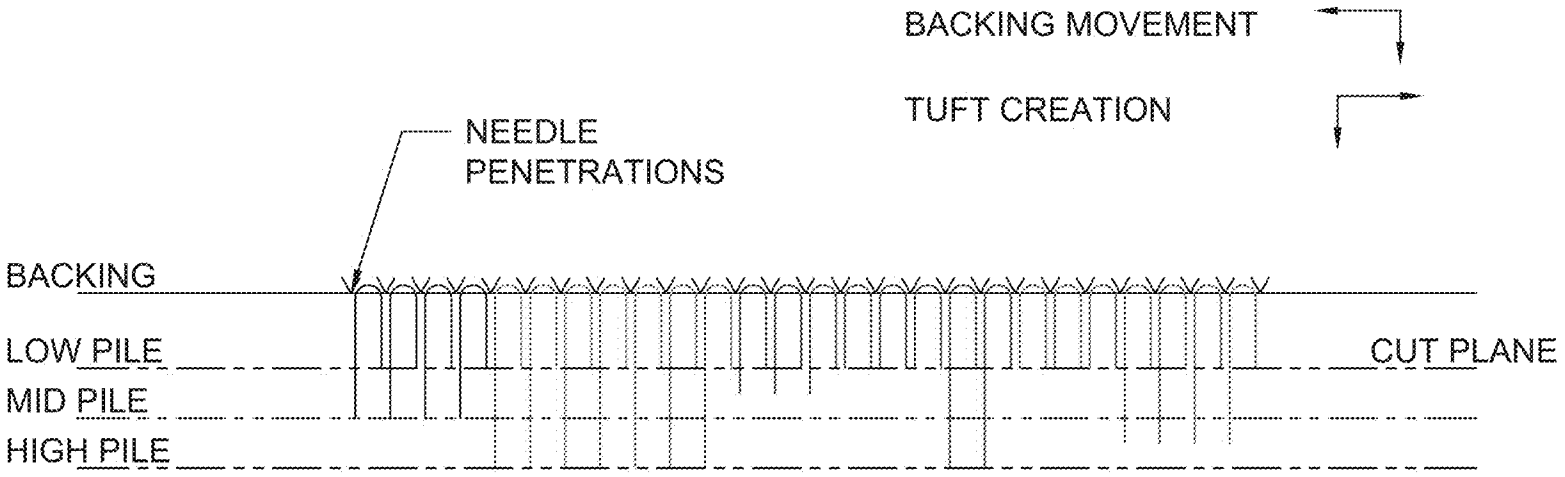

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the disclosed articles, systems, and methods in their best, currently known embodiments. To this end, those skilled in the relevant art will recognize and appreciate that many changes can be made to the various aspects of the articles, systems, and methods described herein, while still obtaining the beneficial results of the disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "a processor" can include two or more such processors unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

The term "tuft", as used herein, encompasses both cut yarn stitches and loop yarn stitches, and the term "tufting" encompasses both the act of forming a cut yarn stitch and the act of forming a loop yarn stitch.

The term "first tuft portion" refers to the first of the two portions of a cut tuft to be formed during a tufting cycle, while the term "second tuft portion" refers to the second of the two portions of the cut tuft to be formed.

The terms "asymmetric tuft" or "uneven tuft" refer to a cut tuft that is formed to intentionally produce first and second tuft portions with unequal pile heights. The longer of the first and second tuft portions of each asymmetric tuft is formed to have a pile height that extends at least 30% (optionally, at least 40%, at least 50%, at least 60%, at least 70%, at least 80%, at least 90%, at least 100%, at least 400%, or at least 800%) above the height of the cut line (the cut plane), while the shorter of the first and second tuft portions of each asymmetric tuft is formed to have a pile height that is within 20% above or below the cut line. Thus, as a non-limiting example, if the cut line were positioned at 1 inch above the bed plate, the first tuft portion of an asymmetrical tuft can have a pile height of at least 1.4 inches, while the second tuft portion of the asymmetrical tuft can have a pile height between 0.8 inches and 1.2 inches. In exemplary aspects, the shorter of the first and second tuft portions can have a pile height that is at or below the cut line. Optionally, the pile heights of the first and second tuft portions of an asymmetric tuft can be "significantly different" as defined herein.

The terms "symmetrical tuft" or "even tuft" refer to a cut tuft that is formed to produce first and second tuft portions having substantially equal pile heights. The first and second tuft portions of each symmetrical tuft are formed to have pile heights that are within 20% (optionally, within 10%) above or below the height of the cut line. Thus, as a non-limiting example, if the cut line were positioned at 1 inch above the bed plate, the first and second tuft portions of a symmetrical tuft could have respective pile heights ranging from 0.8 to 1.2 inches. However, in exemplary aspects, each tuft portion of a symmetrical tuft can be at or below the cut line.

The term "substantially equal" refers to two dimensions that are within 40% (more preferably, within 30%, 20%, 10%, or 5%) of each other. For example, when used to describe the pile heights of first and second tuft portions of a symmetrical tuft, the pile height of the second tuft portion is "substantially equal" to the first tuft portion if the pile height of the second portion is within 40% (more preferably, within 30%, 20%, 10%, or 5%) above or below the pile height of the first tuft portion.

The term "significantly different," when used to describe the pile heights of the first and second tuft portions of an asymmetric tuft, refers to a tuft arrangement in which the pile height of the first tuft portion is intentionally formed to be at least 50% (optionally, at least 60%, at least 70%, at least 80%, at least 90%, at least 100%, at least 120%, at least 150%, at least 200%, at least 400%, or at least 800%) greater or less than the pile height of the second tuft portion. Thus, in a non-limiting example, when the height of the cut line is 1 inch and the pile heights of the first and second tuft portions are significantly different, the height of the second tuft portion can be 1.0 inch, and the height of the first tuft portion can be at least 1.5 inches.

Referring now to the drawings, in which like reference characters indicate like parts throughout the several views, disclosed herein are tufted articles having asymmetric tufts, as well as systems and methods for making such tufted articles. Unlike conventional tufted articles, which are formed and processed to produce symmetrical or even tufts (cut tufts with first and second tuft portions that have substantially equal pile heights), the disclosed tufted articles are formed to deliberately or intentionally include asymmetric or uneven tufts (cut tufts with first and second tuft portions that have unequal (optionally, significantly different pile heights). As further disclosed herein, the asymmetric tufts have a tuft portion with a pile height that is at least 20% above the cut line for a tufting pattern. This is in contrast to known tufting processes, in which the maximum pile height for a particular tuft generally corresponds to the height of the cut line (or is only within a small percentage above or below the cut line). In addition to asymmetric tufts, the disclosed tufted articles can also have at least one symmetrical tuft with a pile height that is less than the highest tuft portion of each asymmetric tuft of the tufted article. In use, the asymmetric tufts of the disclosed tufted articles can cooperate with other tufts of the tufted articles to define unique face profiles and structures and to thereby permit the alteration of the look and feel of face surfaces in desired ways. Exemplary types of tufted articles formed as disclosed herein can include carpets, carpet tiles, rugs, mats, turf products, and the like.

Tufted Articles Having Asymmetric Tufts

Figure 2:
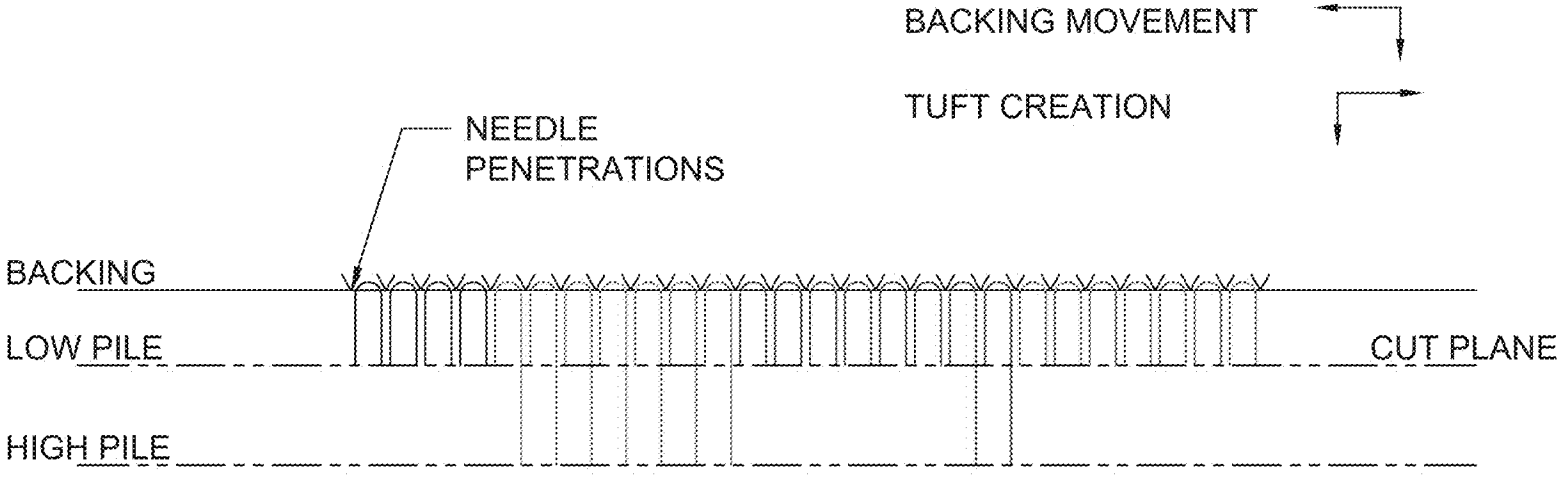
Figure 2B:
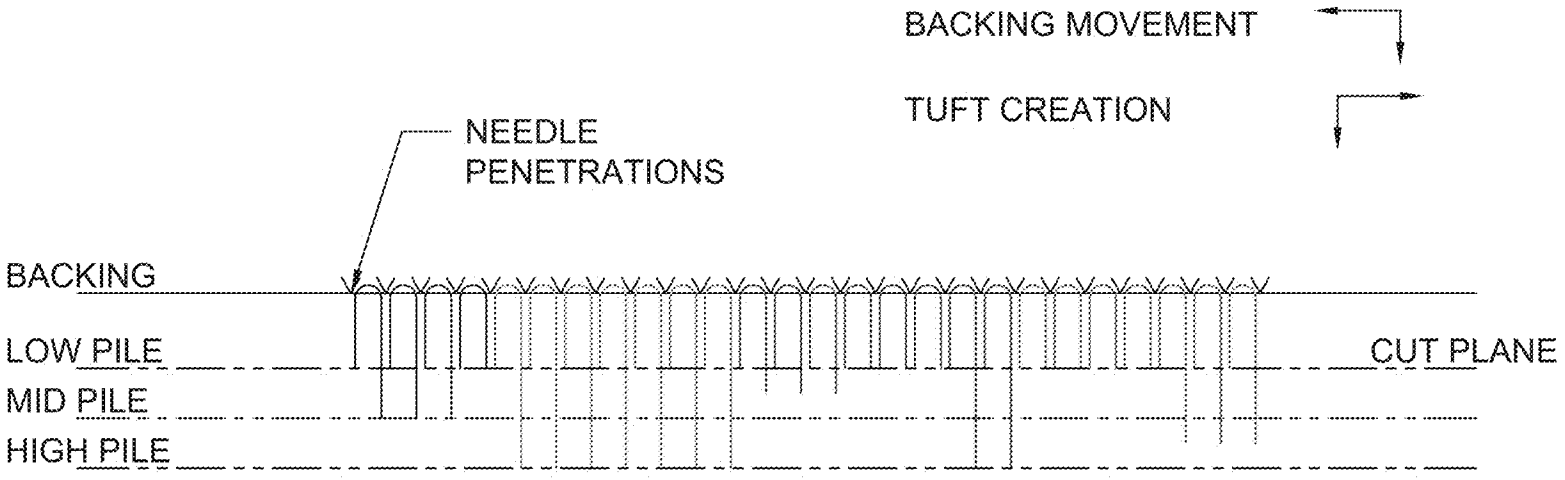
Figure 3:
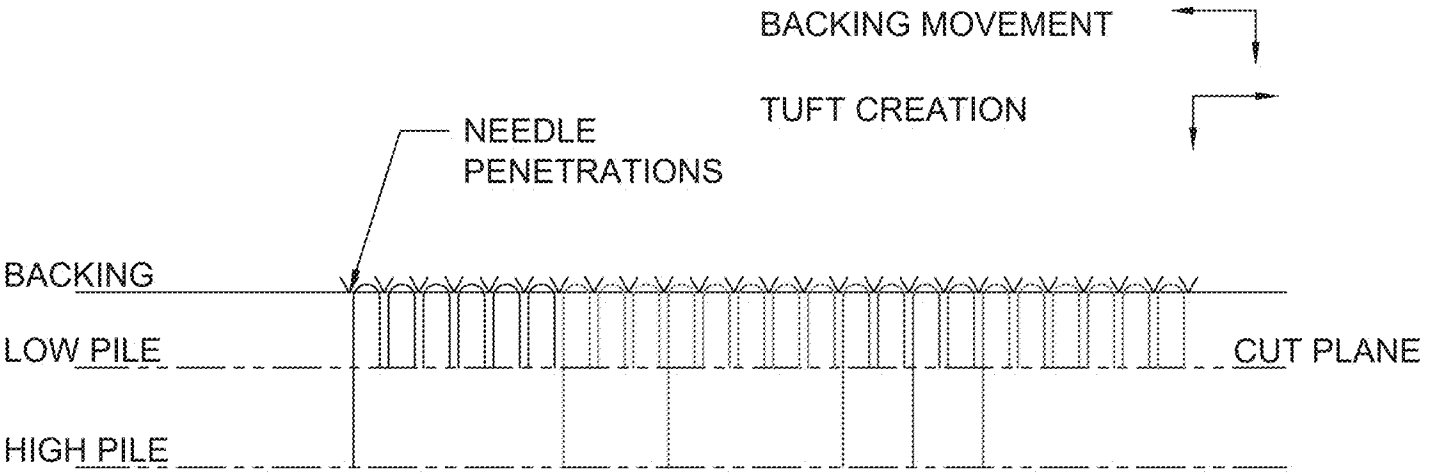
Figure 4:
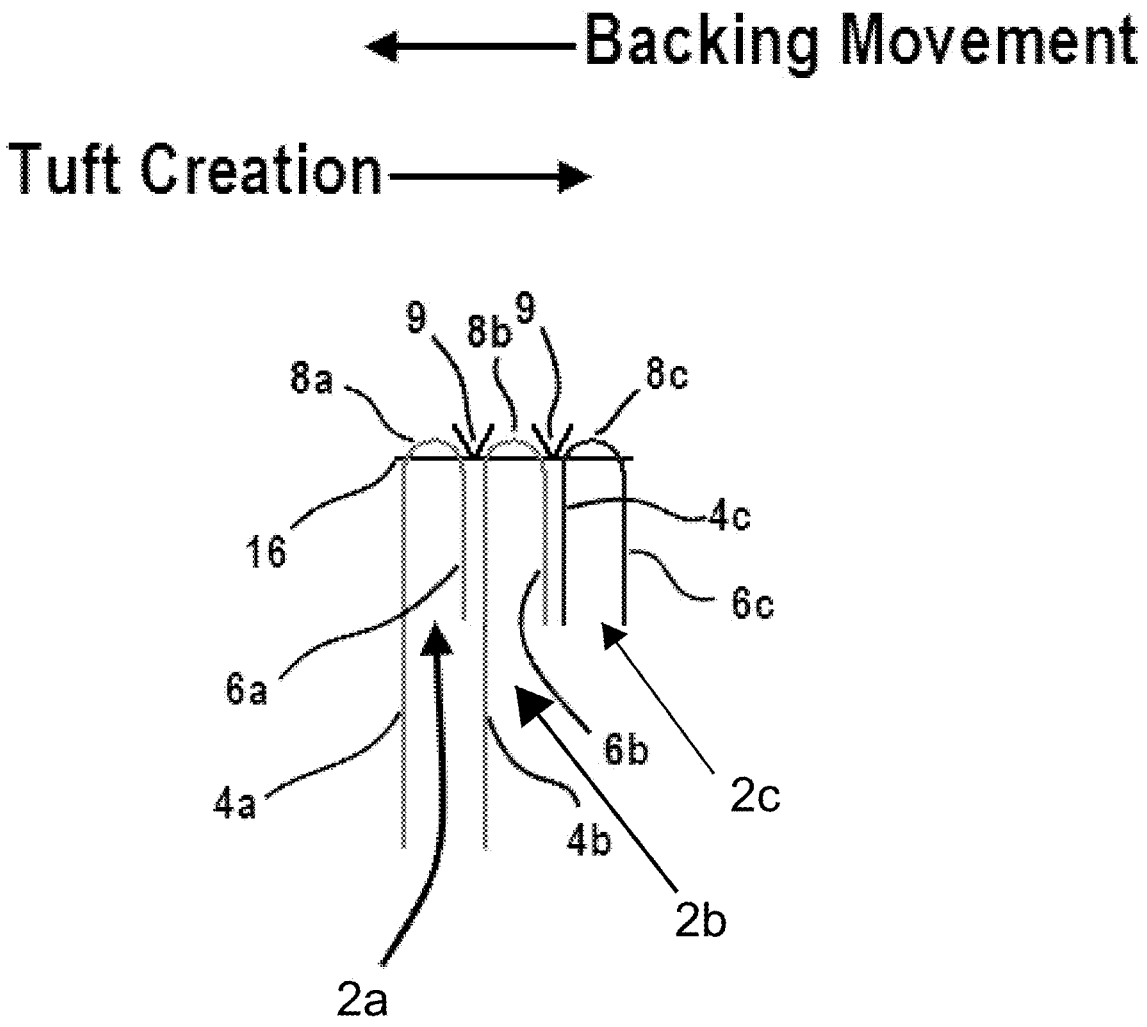
FIG. 4 is a close-up diagram showing the first and second tuft portions and backstitches of cut tufts extending through a backing material as disclosed herein.

With reference to FIGS. 1-4, disclosed herein are tufted articles that comprise a backing material 16 and a plurality of tufts 2*a*, 2*b*, 2*c*. The backing material 16 can have a face surface and an opposed back surface. The plurality of tufts can include a plurality of cut tufts. Each tuft of the plurality of cut tufts can comprise first and second tuft portions projecting from the face surface of the backing material, and the first and second tuft portions can have respective pile heights relative to the backing material. A backstitch can join the first and second tuft portions and extend across a portion of the back surface of the backing material. The plurality of tufts of the tufted article can comprise a plurality of asymmetric tufts that are intentionally formed to have first and second tuft portions with unequal pile heights. As shown in FIG. 4, each cut tuft 2*a*, 2*b*, 2*c* can comprise a first tuft portion 4*a*, 4*b*, 4*c*, a second tuft portion 6*a*, 6*b*, 6*c*, and a backstitch 8*a*, 8*b*, 8*c* that joins the first and second tuft portions. Reference numeral 9 in FIG. 4 refers to locations of needle penetrations into the backing material 16. It is contemplated that any conventional backing material 16, such as woven backing materials as are known in the art, can be used.

In exemplary aspects, the first and second tuft portions and the backstitch of each tuft have respective lengths. Optionally, in various aspects, each tuft can have a total tuft length equal to the sum of the lengths of the first and second tuft portions and the backstitch of the tuft. Optionally, in these aspects, each asymmetric tuft can have substantially the same total tuft length. Alternatively, in other aspects, at least one asymmetric tuft of the plurality of asymmetric tuft can have a different total tuft length than at least one other asymmetric tuft of the plurality of asymmetric tufts. In further aspects, it is contemplated that at least one asymmetric tuft of the plurality of asymmetric tufts can have a different total tuft length than at least two other asymmetric tufts of the plurality of asymmetric tufts.

Figure 1C:
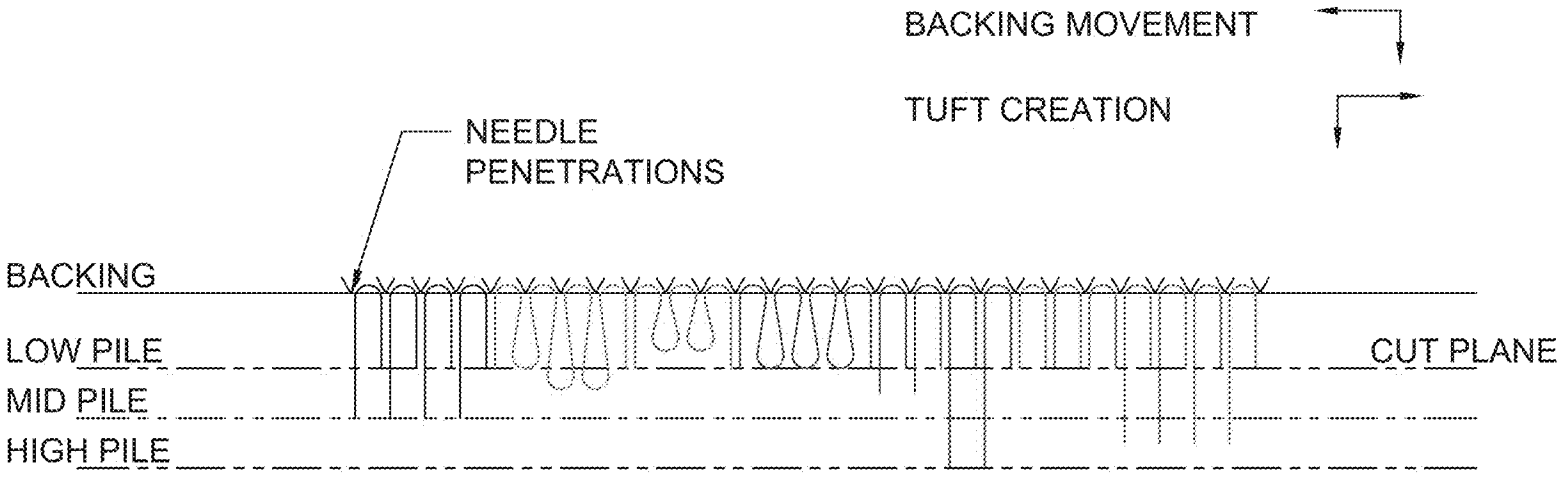
Figure 2C:
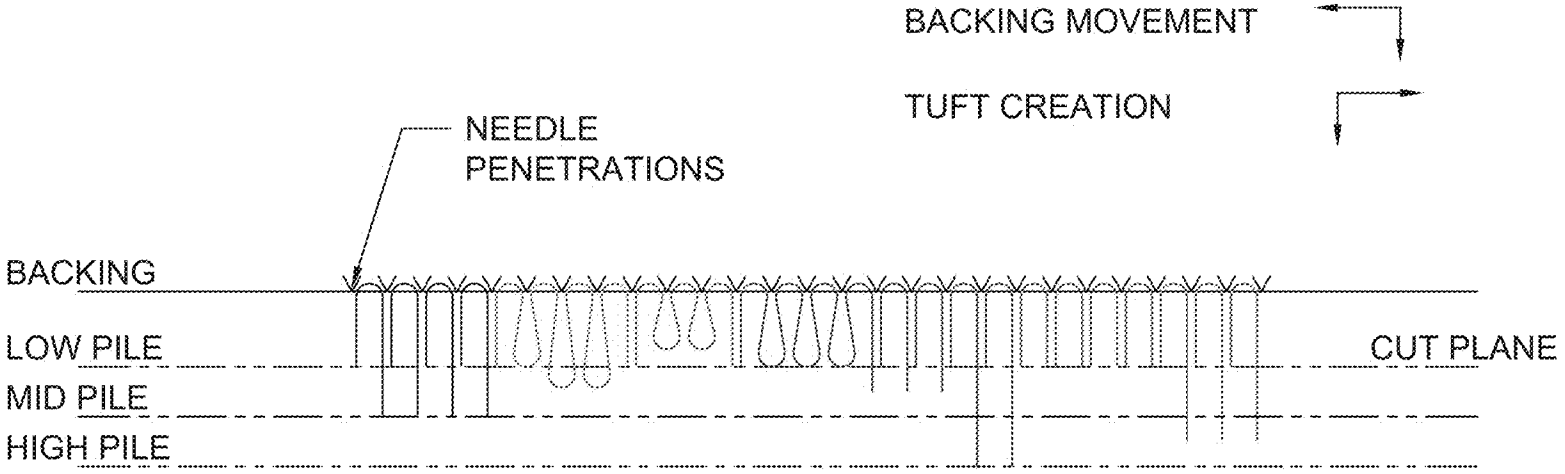
Figure 3B:
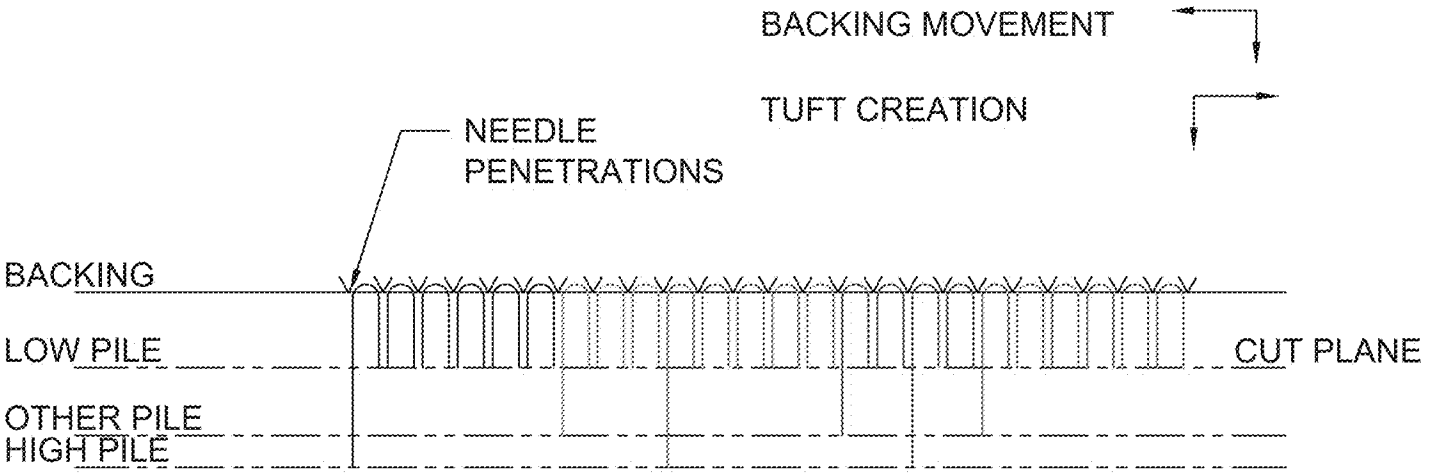
Figure 3C:
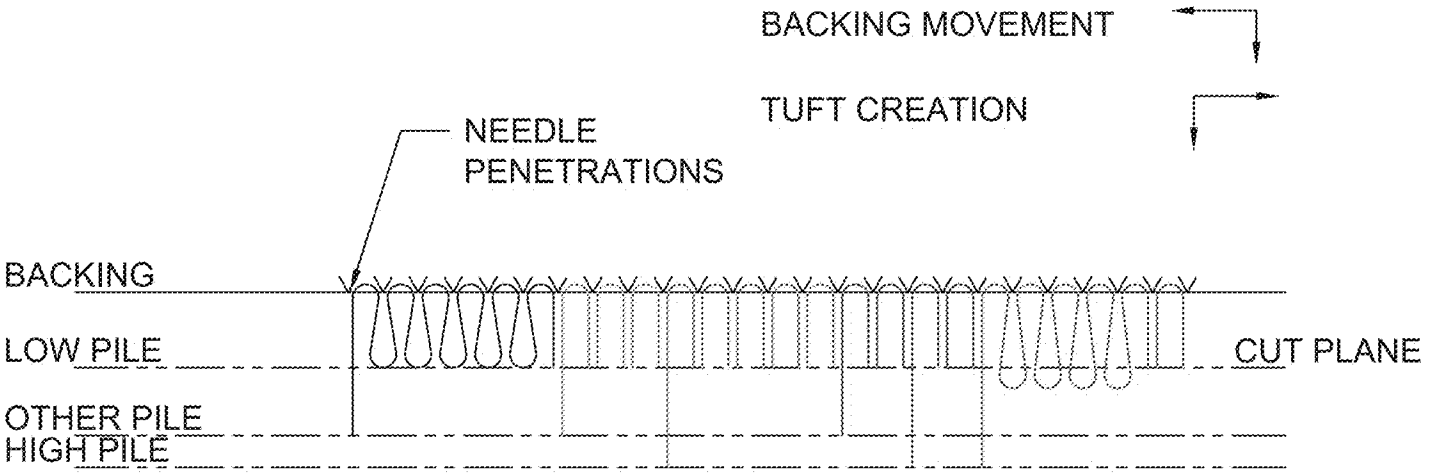

Optionally, as shown in FIGS. 1C, 2C, and 3C, it is contemplated that the tufted articles can include a combination of cut tufts and loop tufts. In exemplary aspects, the loop tufts of the tufted articles can comprise loop tufts having differing pile heights. For example, in these aspects, the loop tufts can have a first group of loop tufts having a first pile height and a second group of loop tufts having a second pile height that is different than the pile height of the first group of loop tufts. In further aspects, it is contemplated that the pile height of at least one loop tuft can be substantially equal to the pile height of at least one symmetrical cut tuft of the article. In further aspects, it is contemplated that the pile height of at least one loop tuft can be less than the pile height of at least one symmetrical cut tuft of the article. In still further aspects, it is contemplated that the pile height of at least one loop tuft can be greater than the pile height of at least one symmetrical cut tuft of the article.

Asymmetric Tufts Having First Tuft Portions with Greater Pile Heights than Corresponding Second Tuft Portions In further exemplary aspects, and with reference to FIGS. 1-1C and 3-3C, the pile height of the first tuft portion of each asymmetric tuft can be greater than the pile height of the second tuft portion of the asymmetric tuft. In these aspects, the pile height of the first tuft portion of each asymmetric tuft can range from about 0.25 to about 3.0 inches, and the pile height of the second tuft portion of the asymmetric tuft can range from about 0.125 to about 1.0 inch. Optionally, the pile height of the first tuft portion of each asymmetric tuft can range from about 0.50 to about 2.0 inches or from about 0.75 to about 1.5 inches, and the pile height of the second tuft portion of each asymmetric tuft can range from about 0.125 to about 0.75 inches or from about 0.125 to about 0.375 inches. It is contemplated that the pile height of the second tuft portion of each asymmetric tuft can be sufficiently long to provide "tuft lock," thereby stabilizing and securing the asymmetric tuft within the backing material.

In additional exemplary aspects, a ratio between the pile height of the first tuft portion of each asymmetric tuft and the pile height of the second tuft portion of the asymmetric tuft can range from about 1.5 to about 24. Optionally, in these aspects, the ratio between the pile height of the first tuft portion of each asymmetric tuft and the pile height of the second tuft portion of the asymmetric tuft can range from about 2 to about 16 or from about 3 to about 12. Thus, it is contemplated that the ratio between the pile height of the first tuft portion of each asymmetric tuft and the pile height of the second tuft portion of the asymmetric tuft can be at least 1.5, at least 2, at least 3, at least 4, at least 5, at least 6, at least 7, at least 8, at least 9, at least 10, at least 11, or at least 12. Optionally, it is contemplated that the ratio between the pile height of the first tuft portion of each asymmetric tuft and the pile height of the second tuft portion of the asymmetric tuft can range from 1.5 to 5, from 1.5 to 8, from 2 to 4, from 2 to 6, from 2 to 8, from 3 to 6, from 3 to 9, from 4 to 6, from 4 to 8, from 4 to 12, from 5 to 15, or from 6 to 16.

In further exemplary aspects, the pile height of the first tuft portion of at least one asymmetric tuft can be different (greater or less) than the pile height of the first tuft portion of at least one other asymmetric tuft of the tufted article. In still further exemplary aspects, it is contemplated that the pile height of the first tuft portion of at least one asymmetric tuft can be different (greater or less) than the pile height of the first tuft portion of at least two other asymmetric tufts of the tufted article. More generally, it is contemplated that any number of pile heights can be used for the first tuft portions of the various asymmetric tufts of the tufted article. Similarly, it is contemplated that any desired pile height can be used for the second tuft portions of the various asymmetric tufts of the tufted article.

In additional aspects, the plurality of tufts can comprise at least one symmetrical tuft having first and second tuft portions with substantially equal pile heights. In these aspects, the first and second tuft portions of the at least one symmetrical tuft can cooperate with the first and second tuft portions of the plurality of asymmetric tufts to define the face pattern of the tufted article. Optionally, it is contemplated that the total tuft length of each asymmetric tuft of the plurality of asymmetric tufts can be greater than the total tuft length of each symmetrical tuft of the at least one symmetrical tuft. In further aspects, it is contemplated that the pile height of the first tuft portion of each asymmetric tuft can be greater than the pile heights of the first and second tuft portions of the at least one symmetrical tuft. Optionally, in these aspects, it is contemplated that the pile height of the second tuft portion of each asymmetric tuft can be equal or substantially equal to the pile heights of the first and second tuft portions of the at least one symmetrical tuft.

In further exemplary aspects, it is contemplated that the plurality of tufts of the tufted article can comprise a plurality of sequential asymmetric tufts that are positioned adjacent one another. In these aspects, it is further contemplated that the plurality of tufts of the tufted article can further comprise a plurality of symmetrical tufts that are positioned adjacent one another such that there are distinct regions of continuous asymmetric tufts and continuous symmetrical tufts.

Asymmetric Tufts Having Second Tuft Portions with Greater Pile Heights than Corresponding First Tuft Portions In additional exemplary aspects, and with reference to FIGS. 2-2C, the pile height of the second tuft portion of each asymmetric tuft can be greater than the pile height of the first tuft portion of the asymmetric tuft. In these aspects, the pile height of the second tuft portion of each asymmetric tuft ranges can range from about 0.25 to about 3.0 inches, and the pile height of the first tuft portion of the asymmetric tuft can range from about 0.125 to about 1.0 inch. Optionally, it is contemplated that the pile height of the second tuft portion of each asymmetric tuft can range from about 0.50 to about 2.0 inches or from about 0.75 to about 1.5 inches, and the pile height of the first tuft portion of each asymmetric tuft can range from about 0.125 to about 0.75 inches or from about 0.125 to about 0.375 inches. It is contemplated that the pile height of the first tuft portion of each asymmetric tuft can be sufficiently long to provide "tuft lock," thereby stabilizing and securing the asymmetric tuft within the backing material.

In exemplary aspects, a ratio between the pile height of the second tuft portion of each asymmetric tuft and the pile height of the first tuft portion of the asymmetric tuft can range from about 1.5 to about 24. Optionally, in these aspects, the ratio between the pile height of the second tuft portion of each asymmetric tuft and the pile height of the first tuft portion of the asymmetric tuft can range from about 2 to about 16 or from about 3 to about 12.

In additional exemplary aspects, the pile height of the second tuft portion of at least one asymmetric tuft can be different (greater or less) than the pile height of the second tuft portion of at least one other asymmetric tuft of the tufted article. In still further exemplary aspects, it is contemplated that the pile height of the second tuft portion of at least one asymmetric tuft can be different (greater or less) than the pile height of the second tuft portion of at least two other asymmetric tufts of the tufted article. More generally, it is contemplated that any number of pile heights can be used for the second tuft portions of the various asymmetric tufts of the tufted article. Similarly, it is contemplated that any desired pile height can be used for the first tuft portions of the various asymmetric tufts of the tufted article.

In further exemplary aspects, the plurality of tufts can comprise at least one symmetrical tuft having first and second tuft portions with substantially equal pile heights, and the first and second tuft portions of the at least one symmetrical tuft can cooperate with the first and second tuft portions of the plurality of asymmetric tufts to define the face pattern of the tufted article. Optionally, in one aspect, the total tuft length of each asymmetric tuft of the plurality of asymmetric tufts can be greater than the total tuft length of each symmetrical tuft of the at least one symmetrical tuft. Optionally, in another aspect, the length of the first tuft portion of each asymmetric tuft can be greater than the first and second tuft portions of the at least one symmetrical tuft. Optionally, in this aspect, the pile height of the second tuft portion of each asymmetric tuft can be substantially equal to the pile heights of the first and second tuft portions of the at least one symmetrical tuft.

Systems for Producing Tufted Articles Having Asymmetric Tufts

Figure 10:
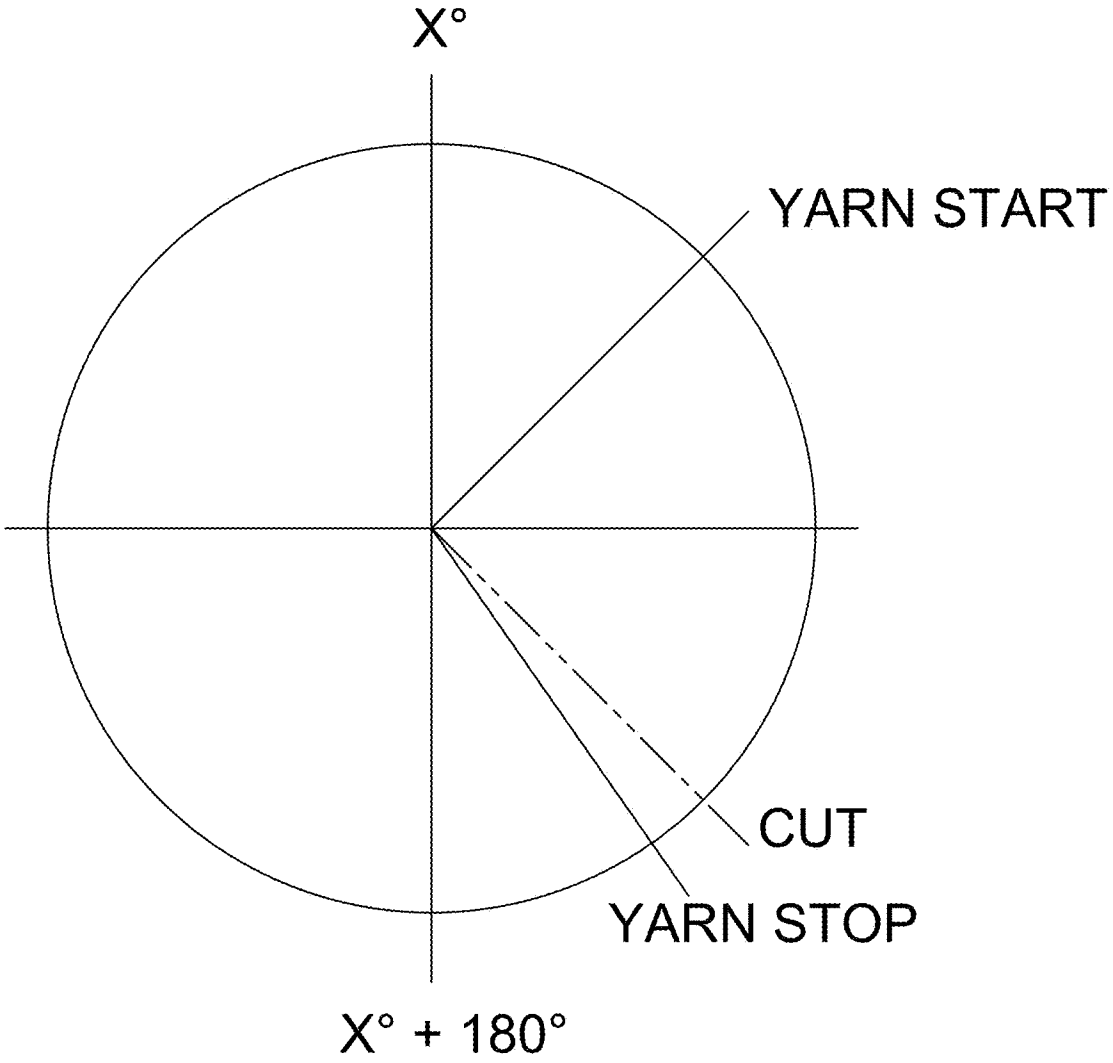
FIG. 10 is a schematic diagram depicting the relationship between a 360-degree rotational cycle of a main shaft, a yarn feed start time, a yarn feed stop time, and the time when a cut is made in a tuft as disclosed herein.

Described herein, in various aspects, is a system for controlling the tufting of a patterned tufted article having asymmetric tufts as disclosed herein. In exemplary aspects, the system can comprise a bed plate, at least one roll assembly (backing transport assembly), a hollow needle, a yarn feed assembly, a needle actuation assembly, a cutting assembly, and at least one processor (which can be provided as a component of a control system). In these aspects, the bed plate can be configured to support a backing material, and the at least one roll assembly (optionally, a plurality of roll assemblies) can be configured to drive movement of the backing material. The hollow needle can have an inlet and an outlet for receiving and delivering yarn as further disclosed herein. The yarn feed assembly can have an inlet and an outlet positioned in communication with the inlet of the hollow needle. In use, and as further disclosed herein, the yarn feed assembly can be configured to direct yarn to the hollow needle during a yarn feed cycle. The needle actuation assembly can be configured to drive sequential strokes of reciprocal movement of the hollow needle relative to a tufting axis to penetrate the backing material and position sequential tufts of yarn through the backing material. It is contemplated that the needle actuation assembly can comprise a main shaft coupled to the hollow needle such that rotational movement of the main shaft imparts corresponding reciprocal movement of the hollow needle. The cutting assembly can be configured to cut the sequential tuft of yarns to form first and second tuft portions of each tuft that project from a face surface of the backing material and are joined by a backstitch of the tuft. The cutting assembly can be configured to cut the sequential tufts of yarn at a fixed cutting location (corresponding to the cut line or cut plane) to produce a second tuft portion of a tuft and define a start of a first tuft portion of the next sequential tuft. During tufting, the distance between the fixed cutting location and the bed plate relative to the tufting axis can be fixed. Thus, in use, it is contemplated that variation in pile height can be achieved without relying on changes in the distance between the fixed cutting location and the bed plate. It is contemplated that the distance between the fixed cutting location (the cut line or cut plane) and the bed plate can range from about 0.1 to about 3.0 inches, from about 0.1 to about 2.0 inches, or from about 0.1 to about 0.8 inches. The at least one processor can be communicatively coupled to the yarn feed assembly and the cutting assembly. During at least one selected stroke of the needle actuation assembly, the at least one processor can be configured to (i) selectively direct the cutting assembly to effect cutting of an asymmetric tuft formed by the hollow needle at a selected cut time, wherein the selected cut time corresponds to a first selected rotational position of the main shaft (measured relative to a starting rotational position of the main shaft, which can optionally be 0 degrees); and (ii) selectively activate the yarn feed assembly during a corresponding yarn feed cycle to deliver selected percentages of a yarn feed before and after the selected cut time to thereby produce a second tuft portion having a pile height that is different than a pile height of the first tuft portion of the asymmetric tuft. For example, as further disclosed herein, the system can be configured to feed more yarn after each cut to form an asymmetric tuft in which the first tuft portion has a pile height that is greater than the pile height of the second tuft portion. As used herein, the term "rotational position" refers to the angular position of the shaft during one revolution or rotation of the shaft, measured relative to an initial rotational position (X as shown in FIG. 10) of the shaft, which can optionally be a 0-degree position corresponding to the top dead center position of the shaft. A schematic diagram depicting one revolution of the shaft, along with a yarn feed start time, a yarn feed stop time, and a cut time, is depicted in FIG. 10. As can be appreciated, the yarn feed can occur during a portion of each revolution of the main shaft, and the tuft to be formed can be cut at a particular time during each revolution of the main shaft. Thus, FIG. 10 is intended to schematically relate the timing of the yarn feed and the cutting action to the rotational position of the main shaft during a tufting cycle.

In exemplary aspects, during formation of an asymmetrical tuft (during a selected stroke), the first selected rotational position of the main shaft can be offset from a halfway point of a corresponding yarn feed cycle (i.e., the point when 50% of the yarn feed has been completed). Optionally, in these aspects, the first selected rotational position of the main shaft can occur before the halfway point of the corresponding yarn feed cycle. For example, it is contemplated that the first selected rotational position of the main shaft can range from about 120 degrees to about 180 degrees, from about 140 degrees to about 170 degrees, or be about 160 or about 165 degrees. However, it is contemplated that any desired rotational position of the main shaft can be used.

In additional aspects, during the at least one selected stroke of the needle actuation assembly for producing an asymmetric tuft, the at least one processor can be configured to deliver a first percentage of the yarn feed to the needle before the selected cut time and to deliver a second percentage of the yarn feed to the needle after the selected cut time. Optionally, in these aspects, the first percentage of the yarn feed can be less than the second percentage of the yarn feed in both duration and length. For example, in some aspects, it is contemplated that the first percentage can range from about 5 percent to about 45 percent, from about 10 percent to about 45 percent, or from about 25 percent to about 45 percent, and the second percentage can range from about 55 percent to about 95 percent, from about 55 percent to about 90 percent or from about 55 percent to about 75 percent. In exemplary aspects, it is contemplated that the first percentage can range from about 30 to about 45 percent (optionally, be about 35 percent or about 40 percent), and the second percentage can range from about 55 percent to 70 percent (optionally, be about 60 percent or 65 percent). However, it is contemplated that any desired first and second percentages can be used, provided it produces an asymmetric tuft as disclosed herein. As one will appreciate, and as further described herein, the second percentage can be greater than the first percentage such that the amount of yarn fed following the selected cut time is greater than the amount of yarn fed before the selected cut time, thereby forming an elongated first tuft portion of the next sequential tuft.

In further aspects, for each selected stroke of the needle actuation assembly, the at least one processor can be configured to selectively direct the yarn feed assembly to begin feeding yarn to the hollow needle at a feed start time that corresponds to a second selected rotational position of the main shaft (measured relative to the initial rotational position of the main shaft, which can optionally be 0 degrees). Optionally, in these aspects, the second selected rotational position of the main shaft can range from about 15 degrees to about 150 degrees. In exemplary aspects, the second selected rotational position ranges from about 100 degrees to about 150 degrees or from about 120 degrees to about 130 degrees. However, it is contemplated that any desired feed start time can be used. As used herein, the term "feed start time" refers to the "actual" feed start time, as is understood in the art.

In still further aspects, for each selected stroke of the needle actuation assembly, the at least one processor can be configured to selectively direct the yarn feed assembly to stop feeding yarn to the hollow needle at a feed stop time that corresponds to a third selected rotational position of the main shaft (measured relative to the initial rotational position of the main shaft, which can optionally be 0 degrees). Optionally, in these aspects, the third selected rotational position of the main shaft can range from about 100 degrees to about 300 degrees. In exemplary aspects, the third selected rotational position can range from about 200 degrees to about 300 degrees, from about 210 to about 290 degrees, or from about 220 degrees to about 250 degrees. However, it is contemplated that any desired feed stop time can be used. As used herein, the term "feed stop time" refers to the "actual" feed stop time, as is understood in the art.

In other aspects, and consistent with the above description, for each selected stroke of the needle actuation assembly (i.e., each stroke during which an asymmetric tuft is produced), the at least one processor can be configured to selectively direct the yarn feed assembly to begin feeding yarn to the hollow needle at a feed start time that corresponds to a second selected rotational position of the main shaft and to selectively direct the yarn feed assembly to stop feeding yarn to the hollow needle at a feed stop time that corresponds to a third selected rotational position of the main shaft. In these aspects, it is contemplated that the angular difference between the second and third selected rotational positions ranges from about 50 degrees to about 200 degrees, from about 50 degrees to about 170 degrees, from about 80 degrees to about 170 degrees, or from about 80 degrees to about 120 degrees.

In exemplary aspects, during at least one other stroke of the needle actuation assembly (i.e., not during a selected stroke that produces an asymmetric tuft), the processor can be configured to selectively control the yarn feed assembly and the cutting assembly to produce a symmetrical tuft having first and second tuft portions with substantially equal pile heights relative to the backing material. In these aspects, during the at least one selected stroke of the needle actuation assembly, the processor can be configured to provide yarn to the needle assembly at a selected yarn feed rate that is greater than a yarn feed rate used to produce the symmetrical tuft during the other stroke. For example, in exemplary aspects, the selected yarn feed rate used to form the asymmetric tufts can range from 0.375 to about 9.0 inches per stitch, from about 0.375 to about 7.0 inches per stitch, from about 0.375 to about 4.0 inches per stitch, from about 0.375 to about 3.0 inches per stitch, from about 1.0 to about 1.4 inches per stitch, from about 1.1 to about 1.3 inches per stitch, or be about 1.2 inches per stitch, whereas the selected yarn feed rate used to form the symmetrical tufts can range from about 0.25 to about 1.2 inches per stitch, from about 0.6 inches per stitch to about 1.0 inches per stitch or be about 0.75 inches per stitch. In exemplary aspects, it is contemplated that the yarn feed rate can remain constant within each stitch. In further exemplary aspects, it is contemplated that the ratio between the selected yarn feed rate used to produce asymmetric tufts and the yarn feed rate used to produce symmetrical tufts can range from about 1.1 to about 12.0, from about 1.2 to about 4.0, from about 1.3 to about 2.0, or from about 1.4 to about 1.8.

In further aspects, during the at least one stroke of the needle actuation assembly that produces a symmetrical tuft, the at least one processor is configured to: (i) selectively direct the cutting assembly to effect cutting of a tuft formed by the hollow needle at a selected cut time; and (ii) selectively activate the yarn feed assembly during a corresponding yarn feed cycle to deliver a first percentage of the yarn feed to the needle before the selected cut time and to deliver a second percentage of the yarn feed to the needle after the selected cut time. In these aspects, the first percentage of the yarn feed can be greater than the second percentage of the yarn feed in both duration and length. For example, the second percentage of the yarn feed for producing a symmetrical tuft can range from about 5 percent to about 45 percent or from about 5 percent to about 30 percent, and the first percentage of the yarn feed can range from about 55 percent to about 95 percent or from about 70 percent to about 95 percent. Optionally, in exemplary aspects, the second percentage can be about 10 percent, and the first percentage can be about 90 percent. However, it is contemplated that any desired percentages can be used.

Optionally, in further aspects, during the at least one stroke of the needle actuation assembly that produces a symmetrical tuft, the selected cut time can correspond to the first selected rotational position of the main shaft. In such aspects, it is contemplated that the selected cut time can be consistently used throughout the tufting of the disclosed tufted articles.

Alternatively, in other aspects, during the at least one stroke of the needle actuation assembly that produces a symmetrical tuft, the selected cut time can correspond to a rotational position of the main shaft that is different from the first selected rotational position of the main shaft. In further aspects, it is contemplated that the at least one processor can be configured to selectively adjust the cut time for each stroke of the needle actuation assembly to achieve desired variations in cutting timing relative to the rotational position of the main shaft.

In additional aspects, for each stroke of the needle actuation assembly that produces a symmetrical tuft, the at least one processor can be configured to selectively direct the yarn feed assembly to begin feeding yarn to the hollow needle at a feed start time that corresponds to a rotational position of the main shaft (measured relative to the initial rotational position of the main shaft, which can optionally be 0 degrees) ranging from about 30 degrees to about 100 degrees or from about 60 degrees to about 100 degrees. In further aspects, for each stroke of the needle actuation assembly that produces a symmetrical tuft, the at least one processor can be configured to selectively direct the yarn feed assembly to stop feeding yarn to the hollow needle at a feed stop time that corresponds to a rotational position of the main shaft (measured relative to the initial rotational position of the main shaft, which can optionally be 0 degrees) ranging from 100 degrees to about 300 degrees, from about 150 degrees to about 275 degrees, from about 150 degrees to about 225 degrees, or from about 160 degrees to about 200 degrees. As one will appreciate, these start and stop times are substantially "earlier" in the main shaft rotation than the start and stop times used to produce asymmetric tufts as disclosed herein. Optionally, in exemplary aspects, it is contemplated that the angular difference (in main shaft position) between the feed stop time used to produce a symmetrical tuft and the feed stop time used to produce the asymmetric tuft can range from about 40 degrees to about 120 degrees or from about 50 degrees to about 90 degrees. Similarly, in other optional aspects, it is contemplated that the angular difference (in main shaft position) between the feed start time used to produce a symmetrical tuft and the feed start time used to produce the asymmetric tuft can range from about 20 degrees to about 100 degrees or from about 40 degrees to about 60 degrees.

In exemplary aspects, and as further disclosed herein, the yarn feed assembly can comprise at least one air cylinder that is configured to deliver yarn to a needle 18. In further exemplary aspects, it is contemplated that the yarn feed assembly can comprise at least one servo motor that is configured to effect delivery of yarn to a needle as further disclosed herein.

In exemplary aspects, it is contemplated that the cutting assembly can be a knife assembly as is known in the art. In further exemplary aspects, it is contemplated that the cutting assembly can be a cut and loop assembly as is known in the art. In these aspects, during at least one stroke of the needle actuation assembly, the at least one processor can be configured to selectively control the yarn feed assembly and the cutting assembly to produce a loop tuft.

Figure 8:
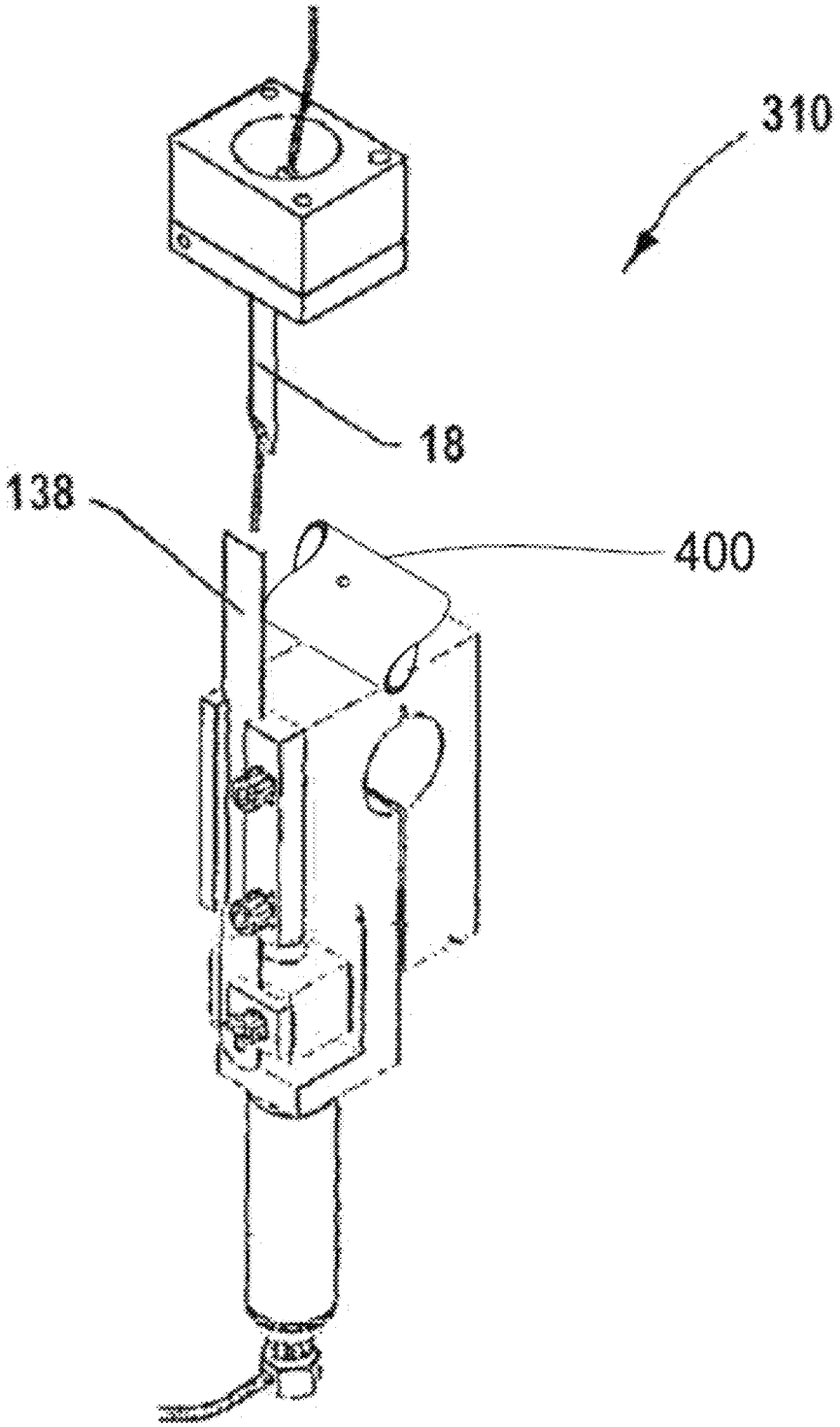
FIG. 8 is a perspective view of an exemplary knife system and an isolated portion of an exemplary air delivery assembly as disclosed herein. As shown, the air delivery assembly can selectively displace portions of yarn tufts to prevent cutting of yarn tufts by the knife system.
Figure 9:
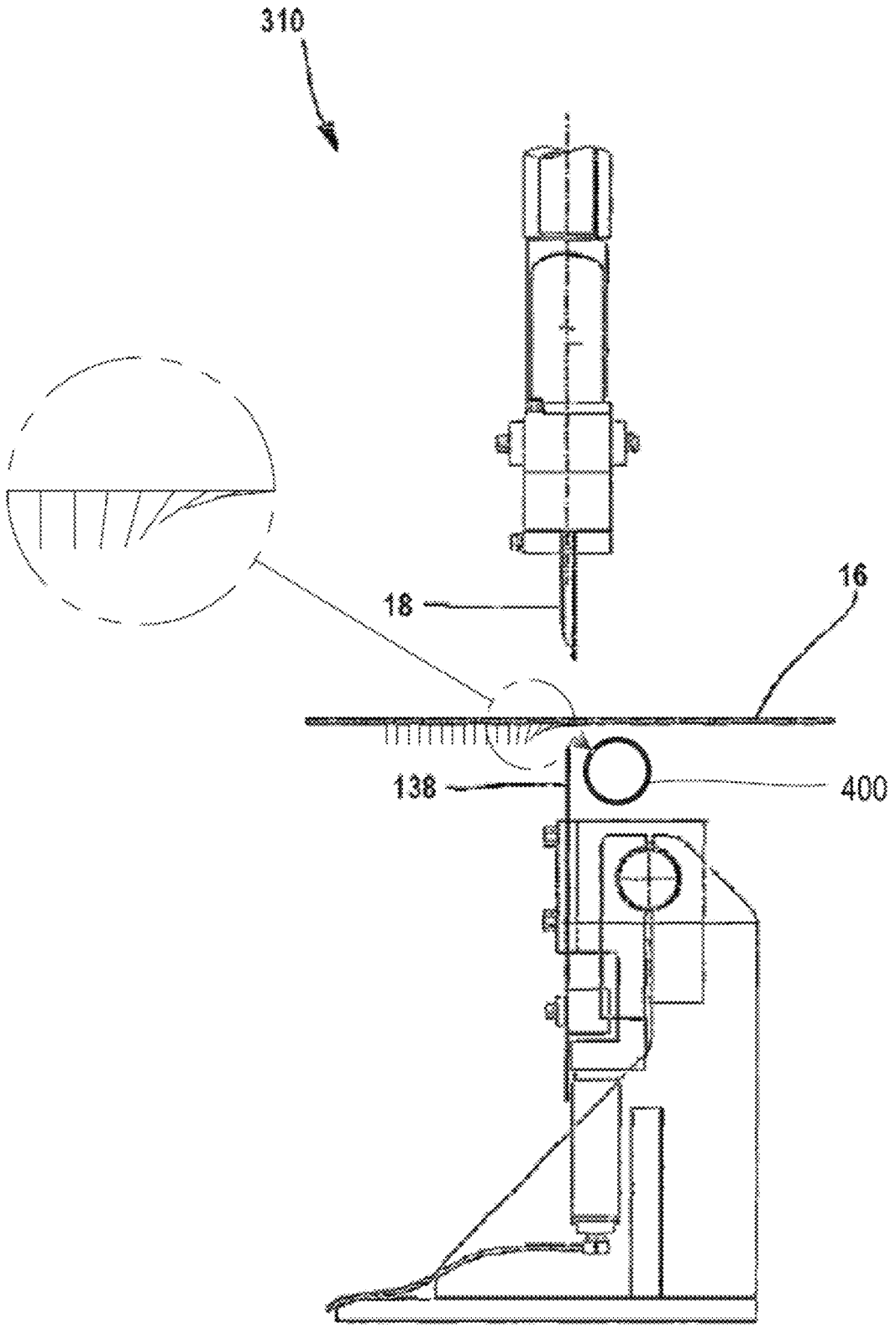
FIG. 9 is an end view of the knife system and air delivery assembly of FIG. 8.

In exemplary aspects, and with reference to FIGS. 8-9, the system can further comprise an air delivery assembly 400, which can optionally be communicatively coupled to the at least one processor. In these aspects, as schematically depicted in FIG. 9, the air delivery assembly 400 can be configured to provide positive air pressure or negative air pressure proximate each tuft to displace portions of the tuft relative to the plane of the at least one bed plate and/or the fixed cutting location. Optionally, the air delivery assembly 400 can provide positive air pressure or negative air pressure in response to selective instruction from the at least one processor. In exemplary aspects, the air delivery assembly 400 can comprise at least one tube or conduit that is configured to receive pressurized air from a pressurized air source or to receive negative pressure air from a negative pressure source. The at least one tube or conduit can define a plurality of openings spaced relative to the length of the tube or conduit, and the at least one tube or conduit can be selectively positioned relative to the cutting assembly such that each opening of the tube or conduit is aligned with and oriented toward a respective cutting location. Optionally, each opening of the air delivery assembly can function as an open port. In other optional aspects, each opening can be positioned in fluid communication with an air jet, a nozzle, or the like. In use, the pressurized or negative pressure air source can be selectively activated to apply pressurized air or negative pressure air to desired cutting locations at a desired speed, pressure, and/or duration. Upon application of the pressurized air or negative pressure air, the yarn extending downwardly from the backing material 16 at the cutting location can be displaced from the plane of the bed plate and/or the cutting location such that the yarn is not cut during movement of the bed plate and/or when the cutting assembly (e.g., knife assembly) advances to the cutting location. It is contemplated that the at least one processor can be communicatively coupled to the pressurized or negative pressure air source and selectively control activation of the pressurized or negative pressure air source and thus, displacement of yarn relative to selected cutting locations.

In exemplary aspects, and with reference to FIGS. 3A-3C, the at least one processor can be configured to modify the parameters of the yarn feed assembly to feed more yarn during insertion than is typically done during a continuous tufting operation, thereby causing yarn to be inserted well beyond (after) cutting action has occurred and ensuring that the yarns are not cut upon insertion. In these aspects, at each yarn/color exchange, it is contemplated that the yarn feed timings can be selectively adjusted to ensure that the yarn is delivered to the hollow needle after the selected cut time, thereby ensuring that the delivered yarn is not cut. It is contemplated that such adjustments to yarn feed timing can be achieved by modification of one or more parameters of the yarn feed assembly, such as an engagement air cylinder and a yarn delivery cylinder as are known in the art. For example, it is contemplated that the pressure in the engagement air cylinder can be increased to receive or catch more yarn than normal, while the yarn delivery cylinder can be slowed down to ensure that the yarn is delivered past the cutting action for a given stroke. Thus, significantly more yarn is fed, but the yarn will not be cut due to the timing of the delivery of the yarn to the needle. Conventionally, as can be appreciated by one of ordinary skill in the art, the long tails produced at color/yarn exchanges are cut by the movement of the bed plate. However, by use of the air delivery assembly disclosed herein, such cutting can be avoided. In exemplary aspects, it is contemplated that the yarn feed start time to create such an asymmetric tuft can occur when the main shaft is positioned at a rotational position well after the time before cutting occurred. Optionally, it is contemplated that the system can comprise a plurality of servo motors, with each servo motor configured to control delivery of yarn from a corresponding yarn feed in accordance with the yarn delivery profile described above.

During formation of an asymmetric tuft, it is contemplated that the yarn feed insertion can correspond to a rotational position of the main shaft ranging from about 220 to about 230 degrees (measured relative to the initial rotational position of the main shaft, which can optionally be 0 degrees), while the cut time can correspond to a rotational position of the main shaft ranging from about 160 degrees to about 170 degrees (measured relative to the initial rotational position of the main shaft). With such adjustments in timing, it is contemplated that the yarn can be delivered to the needle when the needle has already begun its upstroke (the "return" portion of its stroke).

Thus, in these aspects, it is contemplated that asymmetric tufts can be maintained at the first tuft of a "color/yarn exchange" by displacing and keeping portions of the first tuft away from the fixed cutting location during a continuous tufting process. The yarns can be displaced from the cutting zone via an air delivery assembly 400 as disclosed herein, which can include an air manifold, air injectors and/or the like or a combination air manifolds/injectors and/or variations of pressurized air supply means, to thereby prevent the inserted "long" tuft portion of the asymmetric tufts from being cut or removed from a tufted article.

The individual components of the disclosed system are described in more detail in the following paragraphs.

The Tufting Machine

Figure 5:
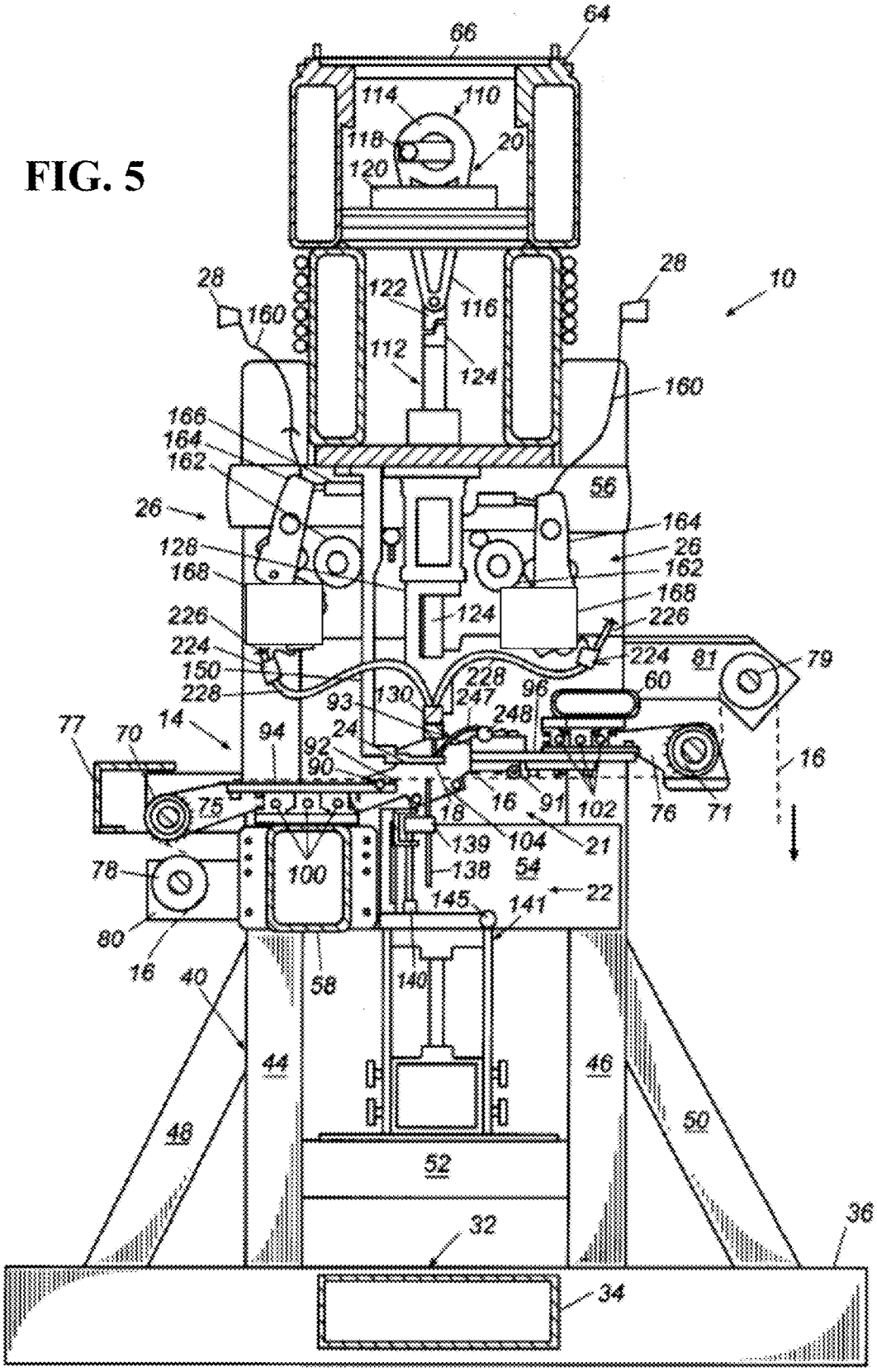
FIG. 5 is a partial sectional elevational view of an exemplary tufting machine as disclosed herein.

An exemplary tufting apparatus 10 is shown in FIG. 5. As shown, the tufting apparatus 10 can comprise a tufting frame 12 supporting a backing transport system 14 for directing a backing 16 through the tufting apparatus, a row of needles 18 mounted to a yarn applicator 20 for implanting tufts of yarn in the backing at a yarn applying region 21, a yarn cutting system 22 for cutting the yarn as it is implanted, presser feet 24, a yarn teed mechanism 26 for supplying continuous lengths of yarn from a yarn supply 28, such as a creel (not shown) to the needles, and a control system 30 for controlling the operation of the tufting apparatus so as to produce a patterned tufted product in accordance with a preselected pattern. The length of the tufting apparatus 10, the spacing of the needles 18, and the number of needles in the apparatus can vary considerably depending on the product to be produced and the desired rate of production. Such a tufting apparatus is described in more detail in U.S. Pat. No. 6,293,211, which is incorporated by reference herein in its entirety.

The Frame

An exemplary frame 12 of the tufting apparatus 10 is shown in FIG. 5 and can comprise a horizontal I-shaped base frame 32, which can include an elongate member 34 extending perpendicularly between end members 36. Vertical end frames 40 can extend upwardly from the end members 36. Each of the end frames 40 can comprise a pair of spaced vertical members 44 and 46, angled support bars 48 and 50 extending between the vertical members and the respective end members 36. In each of the end frames 40, a cutter system frame support bar 52, a backing frame support bar 54, and an upper frame support bar 56 can be spaced from one another and extend between the vertical members 36. A transverse backing support beam 58 can extend between the vertical end frames 40 proximate the backing inlet side 59 of the tufting apparatus 10. Another transverse support beam 60 can extend between the vertical end frames 40 at the exit side 61 of the tufting apparatus 10. Respective end panels 62 can extend between the spaced vertical members 44 and 46 and between the backing frame and upper frame support bars 54 and 56 for supporting various components as described hereinbelow. A plurality of spaced vertical support bars (not shown) can extend vertically between the transverse support beam 60 and elongate main drive housing 64. The main drive housing 64 can extend between the vertical end frames 40 and is mounted on top of the upper frame support bars 56. The interior of the main chive housing 64 can be accessible through removable access panels 66 on top of the main drive housing.

The Backing Transport System

The backing transport system 14 can transport the backing 16 through the tufting apparatus 10 while the reciprocating hollow needles 18 implant tufts of yarn in the backing at the yarn applying region 21. The backing can be in the form of a continuous running web. The backing 16 can move in the direction of the arrow in FIG. 5 and the area through which the backing passes through the tufting apparatus 10 is the yarn applying region 21.

As shown in FIG. 5, the backing transport system 14 can have a roll assembly comprising an entry pin roller 70 and an exit pin roller 71 which are driven by respective electric motors (not shown). The motors can maintain the backing 16 under tension as the backing passes the reciprocating needles 18. The exit pin roller motor can control the tension of the backing 16 and the entry pin roller motor can control the velocity of the backing. The pin rollers 70 and 71 can be mounted to the frame 12 and extend between respective brackets 75 and 76. A guard assembly 77 can be mounted to the frame 12 and extend alongside the entry pin roller 70 to shield the entry pin roller. The backing transport system 14 can further comprise a pair of guide rollers 78 and 79 which cooperate with the pin rollers 70 and 71, respectively, to guide the backing 16. The guide rollers 78 and 79 can be mounted to the frame 12 and extend between respective brackets 80 and 81. The pin roller motors can be connected to the pin rollers 70 and 71 with couplings.

A second pair of pin rollers 90 and 91, which have smaller diameters than the entry and exit pin rollers 70 and 71, can be located closely adjacent to reciprocating needles 18 on the opposite sides of the backing 16. These additional pin rollers 90 and 91 can provide better control of the backing 16 in the area adjacent to where the yarn tufts are implanted. The smaller pin rollers 90 and 91 can be carried on respective brackets 92 and 93.

The backing transport system 14 can further comprise at least one bedplate (e.g., a pair of bed plates 94 and 96) for supporting the backing 16 as the backing moves through the tufting apparatus 10. One of the bed plates 94 can be positioned below the backing 16 and upstream of the reciprocating needles 18 between the reciprocating needles and the entry pin roller 70. The other of the bed plates 96 can be positioned above the backing 16 and downstream of the reciprocating needles 18 between the reciprocating needles and the exit pin roller 71. The at least one bed plate (e.g., bed plates 94 and 96) can be transversely shiftable relative to the backing advance direction.

Each of the bed plates 94 and 96 can be carried on a pair of transversely extending rods 100 and 102 affixed to the frame 12. The bed plates 94 and 96 can be connected at each end by respective connecting members 104 and 105. Optionally, the entry and exit pin rollers 70 and 71 can be carried by the shiftable bed plates 94 and 96, respectively. The connecting members 104 and 105 can be connected to at least one electric motor (not shown) with at least one commercially available ball screw drive. The ball screw drive can be capable of producing very small and precisely controlled transverse movements when rotated by the motor. Specifically, this precision mechanism can enable precisely controlled incremental movements of the order of a half inch to one-tenth of an inch or less. The motor and the ball screw drive can shift the bed plates 94 and 96, as well as the pin rollers 70 and 71, transversely toward the longitudinal direction of advancement of the backing which produces a corresponding transverse shifting movement of the backing 16 so that each needle 18 may insert yarn into the backing at a number of transverse locations. The guide rollers 78 and 79 can also be shifted transversely in substantial correspondence with the pin rollers 70 and 71 by a second, less precise shifting mechanism.

The Needle Actuation Assembly

The needle actuation assembly 20 can reciprocate the needles 18 by adjustable cam assemblies 110 which are coupled to the needles by respective link assemblies 112. The adjustable cam assemblies 110 are shown in FIG. 5 and can comprise a circular cam lobe member 114 rotatably supported by bearings within a circular portion of a yoke member 116. The cam lobe members 114 can be carried on and driven by a transversely extending rotatable shaft 118 which is offset from the center of each cam lobe member and preferably supported by bearings on a bearing support 120. The link assemblies 112 can comprise a coupling link 122 which is pivotally connected to a yoke member 116 and connected to a vertically extending push rod 124. Each vertically extending push rod 124 can extend through and can serve as a guide for vertically reciprocal movement by bearings 126 mounted to the bottom of the main drive housing 64.

Figure 6:
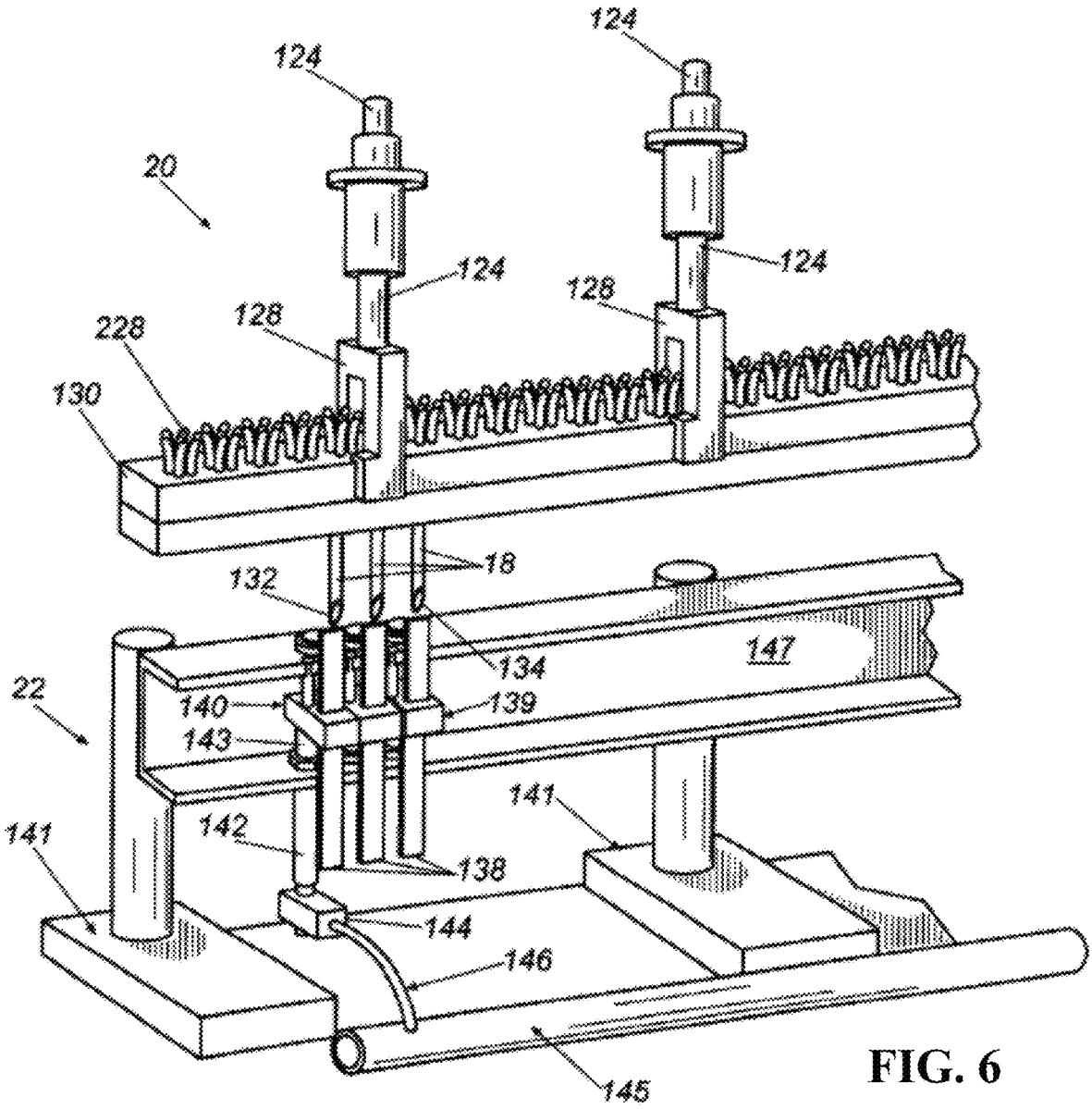
FIG. 6 is a partial perspective view of an exemplary needle actuation assembly and an exemplary yarn cutting assembly as disclosed herein.

As best shown in FIG. 6, the lower ends of the push rods 124 can be connected to respective mounting blocks 128 which are, in turn, can be connected to a transversely extending needle mounting bar 130, which is also referred to as a yarn exchanger. The needles 18 can be mounted to the mounting bars 130. In FIG. 5, only one needle 18 is illustrated, but it should be understood that a plurality of needles 18 can extend along the length of the needle mounting bar 130. Upon rotation of the shaft 118, the adjustable cam assemblies 110 can rotate to impart a reciprocating movement to the yoke members 116 and, in turn, a similar movement to the needles 18 via the link assemblies 112 to cause the needles to repetitively penetrate and withdraw from the backing 16.

The needle mounting bar 130 can be rectangular in cross-section, and for each needle 18, can have a central passage (not shown) extending from an inlet at the top of the mounting bar to a funnel and a plurality of yarn passages (not shown) surrounding each central passage and extending from respective inlets in the top of the mounting bar to the funnel. Each funnel extends from an inlet to an outlet at the bottom of the mounting bar. Such an arrangement is illustrated in detail in U.S. Pat. No. 5,165,352, which is incorporated herein by reference in its entirety.

The needles 18 can each have a hollow passage extending from an inlet to an outlet 132 at a tip 134, which can optionally be an angled pointed tip. An exemplary structure of the needles is disclosed in more detail in U.S. Pat. No. 4,991,523, which is incorporated by reference herein in its entirety. Each needle 18 can be disposed such that the inlet of the needle is in communication with the outlet of the respective funnel.

The needle actuation assembly 20 can be driven by electric motors (not shown) operatively connected to opposite ends of the main drive shaft 118 and mounted to opposite ends of the main drive housing 64 for rotating the main drive shaft. For high product throughput, the main drive motors can rotate the main drive shaft 118 at speeds up to about 1000 rpm.

Each rotation of the main drive shaft 118 can cause the needles 18 to penetrate and then withdraw from the backing 16. In other words, each rotation of the main drive shaft 118 can cause one needle reciprocation cycle, also referred to as a tufting cycle, which includes a downstroke and an upstroke of the needles 18.

During each tufting cycle, the hollow needles 18 of the yard applicator 20 can reciprocate between a top position and a bottom position. The backing can be is positioned between the top position and the bottom position of the tufting; cycle. In one cycle, the tip 134 of each hollow needle 18 can travel from the top position to the bottom position and back to the top position. Between the top position and the bottom position, the hollow needle 18 can penetrate the backing 16 and implant a yard tuft therein. The movement of the hollow needle 18 between the top position and the bottom position is the downstroke of the cycle, and the movement of the needles from the bottom position to the top position is the upstroke of the cycle.

Yarn Cutting Assembly

As shown in FIGS. 5 and 6, the yarn cutting assembly 22 can be positioned below the backing transport system 14 and comprise at least one knife blade 138 (optionally, a plurality of knife blades 138), with one knife blade positioned below each of the needles 18 for cutting the yarn implanted into the backing 16 by the needle at the downstroke of each tufting cycle. The knife blades 138 can be arranged to cooperate with the needles 18 by sliding over the respective tips of the needles 18 in a shearing-like action to cut the yarn that is ejected from the needles. The yarn cutting assembly 22 can further comprise a blade holder 139, a mechanism 140 for reciprocating the knife blade 138, and a frame 141 for supporting the knife blade, blade holder, and reciprocating mechanism.

The reciprocation mechanism 140 for each blade 138 can comprise an air cylinder 142 for driving a shaft 143 in a vertical reciprocating motion and an air solenoid 144 for activating the air cylinder. A pressurized air supply pipe 145 can supply air to the air cylinder 142 as shown in FIG. 6. Tubes 146 can supply the pressurized air supply pipe 145 with pressurized air from a source of pressurized air.

The knife blades 138, blade holders 139, and reciprocating mechanisms 140 can be mounted to the cutting system frame 141 along a transverse C-bar 147. As will be explained in more detail below, each of the knife blades 138 can be individually controlled and can be individually reciprocated independent of the other so that on any penetration by any needle 18, the respective knife blade 138 can be positioned to form a cut tuft or form a loop tuft.

The reciprocating mechanisms 140 can move the knife blades 138 and blade holders 139 up and down synchronous with the reciprocating movements of the hollow needles 18. The knife blades 138 can reciprocate between a bottom position and a top position. Each stroke of the knife blades 138 can include an upstroke from the bottom position to the top position and a downstroke from the top position to the bottom position. In the top position, the knife blades 138 can engage respective hollow needles 18 and cut the yarn. The structure of an exemplary yarn cutting assembly 22 is disclosed in more detail in U.S. Pat. No. 5,588,383, which is incorporated by reference herein in its entirety.

An Alternative Yarn Cutting Assembly

An alternative yarn cutting assembly is generally described in U.S. Pat. No. 7,831,331, which is incorporated herein by reference in its entirety. Referring now to FIG. 8, a perspective view of an exemplary knife system 310 is provided. The knife system 310 can include a knife 138. While FIG. 8 illustrates only a single grounded needle 18, it is contemplated that the knife system can be provided with more than one needle. In addition, while FIG. 8 illustrates the needle 18 receiving only a single strand of yarn, it is contemplated that the needle can receive more than one strand of yarn.

As shown in FIG. 8 and referenced above, the knife system 310 can also include a knife 138 which is adapted to be moved between a cutting position and a non-cutting position. More particularly, the knife 138 can be adapted to be moved into a position in which its distal end is nearest to the distal end of needle 18, i.e., the cutting position. Preferably, when the knife is in the cutting position, it can make contact with the needle 18 when the needle is moved to its penetrating position. Conversely, when the knife 138 is moved into a position in which its distal end is farthest from the distal end of needle 18, i.e., the non-cutting position, the knife will not make contact with the needle 18 or will not make sufficient contact to effect cutting, even when the needle is moved to its penetrating position.

While FIG. 8 illustrates only a single knife 138, it is contemplated that the knife system can include more than one knife. It is further contemplated that the knife or knives can be of any suitable configuration adapted to cut the yarn received by the needle or needles.

Referring now to FIG. 9, an end view of knife system 310 is illustrated. As shown in FIG. 9, the knife system 310 can include needle 18 and knife 138. As can be appreciated from FIG. 9, the needle 18 can be adapted to move between a non-penetrating; position (as shown) in which the needle is not in contact with backing 16 of tufted floor covering and a penetrating position (not shown) in which the distal end of the needle penetrates the backing. As can also be appreciated from FIG. 9, when the knife is moved into a position in which its distal end is nearest to the distal end of needle 18, i.e., the cutting position, the knife can make contact with the needle when the needle is moved to its penetrating position. Conversely, when the knife is moved into a position in which its distal end is farthest from the distal end of needle 138, i.e., the non-cutting position, the knife will not make not make contact or will not make sufficient contact with the needle to cut a tuft when the needle is moved to its penetrating position. The needle 18 can be adapted to be moved between the penetrating position and the non-penetrating position by a rotating drive shaft or any other suitable means.

The Presser Feet

Optionally, to prevent the needles 18 from raising the backing 16 when the needles are removed from the backing during the upstroke of the yarn applicator 20, a plurality of presser feet 24 can be disposed adjacent the needles transversely across the tufting apparatus 10 and slightly above the backing. The presser feet 24 can be connected to an elongated rail member 150, shown in FIG. 5, with means such as screws. The rail member 150 can be connected to the underside of the main drive housing 64 with arms 152 to fix the presser feet 24 to the tufting apparatus frame 12.

Each of the presser feet 24 can extend below the needles 18 and have a plurality of bores corresponding to each needle and through which the respective needles may reciprocate freely.

Air conduits 248 can communicate with each of the needle bores. Pressurized air can be blown through the conduits 248 by corresponding tubes 155 connected to a pressurized air pipe 156. Pressurized air can be directed through the conduits 248 and into the needle bores as the needles 18 are withdrawn from the backing 16. This air can force the severed limb of yarn, which is the limb forming the last backstitch and which is no longer connected to the needle, down into the opening in the backing before the needle makes a subsequent opening. This can eliminate the excess yarn on the rear of the backing and preclude the yarn from forming a backstitch raised above the surface of the backing material. Optionally, each air conduit 248 can be disposed at an angle of about 45° relative to the axis of the respective needle 18. Exemplary presser feet 154 are disclosed in U.S. Pat. No. 5,158,027, the disclosure of which is incorporated by reference herein in its entirety.

The Yarn Feed Assembly

The tufting apparatus 10 can supply at least one yarn (e.g., a plurality of different yarns) to each needle 18 of the tufting apparatus. The yarns can be of different colors so that the tufting apparatus 10 can be used to make multicolor patterned tufted goods such as carpet. The tufting apparatus 10 can have a plurality of needles spaced apart. The particular number of needles depends on the product to be produced and the level of throughput desired. The tufting apparatus 10 is capable of selecting, for any given needle 18, on any given needle reciprocation cycle, one yarn of a plurality of different yarns and delivering the desired length of that yarn to the respective needle. In addition, the tufting apparatus is capable of simultaneously withdrawing one yarn from a needle 18 and inserting another yarn into that needle in the same needle reciprocation cycle.

Yarn can be supplied to the tufting apparatus 10 through overhead tubes from a creel (not shown). The creel generally comprises a frame for holding a plurality of yarn spook. The structure and function of such creels is well known to those skilled in the art and is not discussed herein in detail.

At least one yarn feed assembly 26 can be disposed adjacent the push rod 124 of the yarn cutting system 22 and extend between the vertical end frames 40 of the tufting frame 12 along the inlet and exit sides 59 and 61 of the tufting apparatus. The yarn feed assemblies 26 on each side of the tufting apparatus 10 can identical to each other, but in reverse image. Each yarn feed assembly 26 can comprise a driven roller 162 extending between end panel 62 of the vertical end frames 40. In addition, each yarn feed assembly 26 can include a yarn feeder 164 which is driven by the driven roller 162, and an actuator 166 pivotally connected to the yarn feeder for pivoting the yarn feeder. Accordingly, there can be several yarn feeders 164 and actuators 166 associated with each tufting needle 18. In exemplary aspects, the yarn feed assembly 26 can comprise a yarn cylinder 168 as further disclosed herein.

Each driven roller 162 can be concentrically mounted about a drive shaft which extends the length of the tufting apparatus 10. Each drive shaft can be independently driven by respective electric motors (not shown). Therefore, each driven roller can be rotated at different speeds allowing for different yarn feed rates. As is known in the art, this can allow for tufts of different pile height in the same tufted good.

Each yarn feeder actuator 166 can move the respective yarn feeder 164 into and out of peripheral engagement with the respective driven roller 162. Suitable actuators can include a pneumatic cylinder and other reciprocating devices such as an electric solenoid or a hydraulic actuator.

Optionally, a stationary manifold bar 224 can extend between the vertical end frames 40 of the tufting frame 12 and receive the yarn 160 from each of the yarn feeders 164 along the length of tufting apparatus. The manifold bar 224 can have a plurality of passageways through which the yarns 160 pass. These passageways (not shown) can lead the yarns to respective flexible yarn delivery tubes 228 which extend from the manifold bar 224 to respective yarn passageways in the needle mounting bar 130. In addition, the manifold bar 224 can include a plurality of respective pressurized air conduits 226 for receiving pressurized air and directing it through the yarn passageways and the manifold bar and flexible yarn delivery tubes 228 to force the yarns 160 through the respective yarn delivery tubes, through the passageways in the needle mounting bar and through the hollow needles 18.

Optionally, as further disclosed herein, the at least one yarn feed assembly 26 can comprise at least one servo motor (optionally, a plurality of servo motors), with each servo motor being configured to control delivery of a respective yarn in accordance with processor control based on an automated process, pattern file, or through instructions received from a user/operator (e.g., through a human-machine interface (HMI).

The Control System

Figure 7:
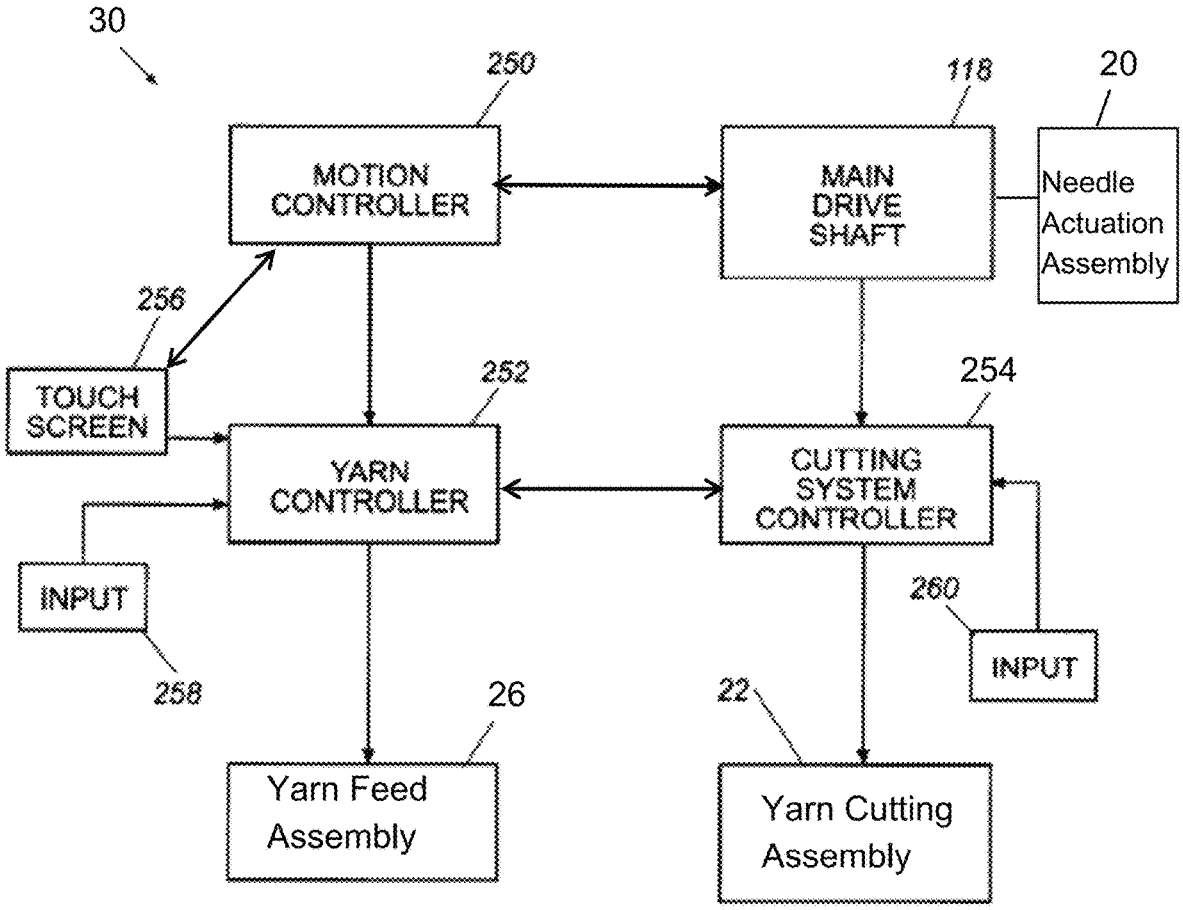
FIG. 7 is a schematic diagram of an exemplary control system of a tufting machine as disclosed herein.

The control system 30 of the tufting apparatus 10 can receive instructions from an operator and/or a pattern file input (separate from the operator instructions) for making a particular product such as a patterned carpet. In use, as further described herein, the control system can control the various subsystems of the tufting apparatus, including the backing transport system 14, the needle actuation assembly 20, the yarn cutting assembly 22, and the yarn feed assembly 26, in accordance with the operator's instructions to make the desired product. As shown in the schematic diagram of FIG. 7, the control system 30 for the tufting apparatus 10 can comprise a motion controller 250 for controlling the motors driving the backing transport system 16, the needle actuation assembly 20, and the yarn feed assembly 26, a yarn controller 252 (which includes at least one processor and can optionally be a computer), a yarn cutting controller 254 (which includes at least one processor and can optionally be a programmable computer), and an operator control interface 256. The function of each of the components of the control system 30 is described below in detail so that one skilled in the art can obtain or prepare the appropriate software to carry out the respective functions.

The motion controller 250 can control and coordinate the motors mounted on the tufting apparatus 10 for driving the backing transport system 16, the needle actuation assembly 20 via the main drive shaft 118, and the yarn feed assembly 26 via the driven rollers 162. The motion controller 250 can communicate with the yarn controller 252 and generate data representing the position and speed of movement of the main drive shaft 118. The motion controller can include a processor, which can be provided as a component of a computing device, such as a personal computer, a laptop computer, a tablet, a smartphone, a programmable logic controller, and the like. An exemplary motion controller is a GALIL model 1040 motion controller manufactured by GALIL Motion Control, Inc., of Sunnyville, Calif.

The yarn controller 252 can comprise at least one computing device (such as a personal computer, a laptop computer, a tablet, a smartphone, a programmable logic controller, a programmable automation controller, at least one servo drive, at least one hardware interfacing device, and the like) that is programmed with operator utility software and run time software and generally stores yarn color pattern information and controls operation of the yarn feed assembly 26 in accordance with the selected multi-colored pattern. The operator utilities software can include functions such as selecting pattern files from a pattern input 258 such as a stored pattern file, decompressing or compressing pattern files, changing pattern colors, setting up the yarn creel, and performing diagnostic functions with the yarn control input/output. Optionally, patterns such as multi-colored patterns for carpet can be scanned using a conventional multi-color pattern scanning device, translated into a pattern file, and downloaded onto a disk, flash drive, or the hard drive of the yarn controller 252. The operator can input instructions through the operator control interface 256 for the timing of the tufting operation.

The run time software can control the yarn colors and pattern generation during operation of the tufting apparatus 10. The run time software can allocate the pattern information from the pattern file to the correct needles 18 at the correct time relative to the position of the main driveshaft 118. In the event the yarn feed comprises at least one servo motor for controlling delivery of an individual yarn, the run time software can provide pattern information to each servo motor to ensure that the yarn is delivered in the correct amount and at the correct rate.

The cutting system controller 254 can comprise at least one computing device (such as a personal computer, a laptop computer, a tablet, a smartphone, a programmable logic controller, a programmable automation controller, at least one hardware interfacing device, and the like) that controls the yarn cutting assembly 22 in accordance with a cut/loop pattern so as to selectively cut the yarn and plant it in the backing to form a cut tuft or alternatively form a loop tuft, so that the tufted good has both cut tufts and looped tufts. Like the yarn controller 252, the cutter controller 254 can include operator utility software and run time software. The cutting system controller 254, however, can receive and store cut/loop pattern information from a cut/loop pattern input 260 such as a stored pattern file.

The run time software of the cutting system controller 254 can allocate the pattern information to the appropriate knife blades 113 at the correct time relative to the main shaft 118 position, and send a signal to the appropriate knife blade reciprocating mechanism 140 to selectively cut yarn or not cut yarn to form the desired cut/loop pattern. Although the yarn controller 252 and the cutting system controller 254 are synchronized, they can operate independently of one another so that yarn color patterns and cut/loop patterns can be implemented independently for each tufted good. Therefore, any yarn color pattern can be combined with any cut/loop pattern to produce a wider variety of tithed goods.

Operation of the Tufting Machine

After the tufting apparatus 10 is properly set up, the tufting apparatus can produce, in one pass, tufted patterned articles, such as carpet, carpet tiles, turf products, and the like. Optionally, the tufting apparatus 10 can be configured to produce multi-colored articles. For example, the tufting apparatus 10 can be set up to deliver six different yarns to each needle, but also could be set up to produce carpet having a pattern with more or less than six colors. In addition, the tufting apparatus 10 can produce a patterned carpet having some cut tufts and some loop tufts. The cut and loop tufts can be arranged to form a pattern themselves independent from the yarn color pattern. Furthermore, the tufting apparatus can be set up to produce a patterned article having tufts of different pile heights in the same carpet and can be set up to produce patterned carpet having various tuft constructions (i.e., various gauges and stitch rates). These methods are explained in more detail below.

To set up the tufting apparatus 10, the control system 30 can first be programmed with the appropriate pattern and the timing data, and the air pressures for the pneumatic systems and the presser foot can be set via the operator control interface touch screen 256 to levels appropriate for the types of yarns being used. The yarn color pattern can be fed to the yarn controller 252 through the yarn color pattern input 258, and the cut/loop pattern can be fed to the cutting system controller 254 through the cut/loop pattern input 260. The speeds of the driven rollers 162, 71, 75 and bed plates 94, 96 in the needle actuation assembly 20 can be set to achieve the desired pile height, stitch gauge, or stitch rate for the tufts. Next, the backing 16 can be fed into the backing transport system 14, and the yarns can be mounted on the creel and fed through overhead tubes, the yarn supply mechanisms 26, and the yarn delivery tubes 228 to the yarn applicator 20.

The motion controller 250 can also be programmed with the stitch gauge of the pattern being used so that the backing advance motors, the backing shifting motors and the main drive motors cooperate to reproduce the desired pattern in the tufted product. The tufting; operation can be initiated by the operator by sending a start signal to the control system 30. The backing transport system 14, the yarn applicator system 20, the yarn cutting system 22, and the yarn feed mechanism 26 can then begin simultaneous operation to produce carpet having the pattern being implemented by the control system 30. Each full rotation of the main drive shaft 118 is a cycle of the tufting apparatus 10. Through the adjustable cam assemblies 110 and the link assemblies 112, the needles 18 can be reciprocated by the rotation of the main drive shaft 118. For every rotation of the main drive shaft 118, the needles 18 can reciprocate through a full cycle which includes a downstroke and upstroke. During each reciprocation cycle of the yarn applicator 20, the needles 18 can implant a yarn tuft into the backing 16. As the backing advance motors advance the backing 16 and the backing shifting motors move the backing transversely to the direction of advancement of the backing, the reciprocating needles 18 can penetrate the backing and implant yarn in the backing successively along transverse rows.

During each cycle of the tufting apparatus 10, yarns can be fed to the needles 18 by the yarn feeders 164. The yarn feeders can feed a yarn to each needle 18 during each stroke so that a yarn is tufted by each needle at each penetration of the backing 16 by the needles. In accordance with data sent by the yarn controller 252 to tufting apparatus 10, the yarn feed mechanisms 26 can feed yarn, selectively retract or not retract yarn, or hold yarn in accordance with the pattern being implemented by the yarn controller. Optionally, the yarn feed mechanisms 26 can be configured to provide unidirectional yarn flow such that they do not retract yarn.

Methods of Producing Tufted Articles Having Asymmetric Tufts

In use, and as further disclosed herein, the disclosed systems can be used in a method of controlling the tufting of a patterned tufted article as disclosed herein. In exemplary aspects, the method can include supporting a backing material on a bed plate and using a yarn feed assembly to direct yarn to a hollow needle during a yarn feed cycle. In other aspects, the method can further comprise using a needle actuation assembly to drive sequential strokes of reciprocal movement of the hollow needle relative to a tufting axis to penetrate the backing material and position sequential tufts of yarn within the backing material. In further aspects, the method can comprise using a cutting assembly to cut the sequential tufts of yarn to form first and second tuft portions of each tuft that project from the face surface of the backing material and are joined by a backstitch of the tuft. In these aspects, the cutting assembly cuts the sequential tufts of yarn at a fixed cutting location to produce a second tuft portion of a tuft and define a start of a first tuft portion of the next sequential tuft, and, during tufting, the distance between the fixed cutting location and the bed plate relative to the tufting axis is fixed. During at least one selected stroke of the needle actuation assembly, the method can comprise using the at least one processor to (i) direct the cutting assembly to effect cutting of a tuft formed by the hollow needle at a selected cut time that corresponds to a first selected rotational position of the main shaft; and (ii) selectively activate the yarn feed assembly during a corresponding yarn feed cycle to deliver selected percentages of a yarn feed before and after the selected cut time to thereby produce a second tuft portion having a pile height that is different than a pile height of the first tuft portion of the tuft.

As further disclosed herein, during at least one stroke of the needle actuation assembly, the method can comprise using the processor to selectively control the yarn feed assembly and the cutting assembly to produce a symmetrical tuft having first and second tuft portions with substantially equal pile heights relative to the backing material. In one aspect, during the at least one selected stroke of the needle actuation assembly, the processor can provide yarn to the needle assembly at a selected yarn feed rate that is greater than a yarn feed rate used to produce the symmetrical tuft. In another aspect, during the at least one stroke of the needle actuation assembly that produces a symmetrical tuft, the at least one processor can: (i) selectively direct the cutting assembly to effect cutting of a tuft formed by the hollow needle at a selected cut time; and (ii) selectively activate the yarn feed assembly during a corresponding yarn feed cycle to deliver a first percentage of the yarn feed to the needle before the selected cut time and to deliver a second percentage of the yarn feed to the needle after the selected cut time. In these aspects, and in contrast to some of the disclosed methods of producing asymmetric tufts, the first percentage of the yarn feed can be greater (optionally, at least 10% greater, at least 20% greater, at least 30% greater, at least 40% greater, or at least 50% greater) than the second percentage of the yarn feed in both duration and length. Exemplary yarn feed percentage ranges are described herein with reference to the disclosed systems.

During each stroke of the needle actuation assembly following a selected stroke of the needle actuation assembly (i.e., a stroke during which an asymmetric tuft is produce), it is contemplated that the needle will back-rob portions of yarn fed following the cutting of a preceding tuft of yarn, and the back-robbed portions of yarn form the back stitch, the second tuft portion of the corresponding tuft, and the first tuft portion of the next sequential tuft of yarn.

Optionally, in exemplary aspects, during the at least one selected stroke of the needle actuation assembly, the method can further comprise using the at least one processor to selectively direct an air delivery assembly to provide positive air pressure proximate each tuft and displace the longer of the first and second tuft portions of the tuft relative to the fixed cutting location.

Between sequential strokes of the needle actuation assembly, the method can further comprise advancing the backing material relative to an axis that is perpendicular to the tufting axis.

In exemplary aspects, the method does not comprise adjusting the pile heights of the first and second tuft portions of each tuft formed during a selected stroke of the needle actuation assembly.

An exemplary tufting method is described below with reference to FIG. 1. As stated in the figure, backing motion is to the left of the page, with tufting advancing to the right of the page. During generation of symmetrical tufts, a yarn is inserted into the backing via the hollow needle, the needle rises from the backing and the backing shifts right and continues forward. As the needle begins its down stroke, the back stitch is generated, back robbing occurs, and a short yarn feed begins. The cut is then completed, thereby forming the second tuft portion of the first tuft (the height equaling the distance between the backing/bedplate and cutting edge of the knife), and the yarn from the first tuft is no longer connected to the needle or feed mechanism). The yarn feed ends, and the first tuft portion of the next sequential tuft is generated. As the needle rises from the backing, the backing shifts right and continues forward. As the needle begins the down stroke, the back stitch is generated, back robbing occurs and a short yarn feed begins. The cut is then completed, thereby forming the second tuft portion of the second tuft (the height equaling the distance between the backing/bedplate and cutting edge of the knife), and the yarn from the second tuft is no longer connected to the needle or feed mechanism. The yarn feed ends, and the first tuft portion of the next sequential tuft is generated. This process can continue for this yarn until the next "color/yarn exchange" occurs.

During generation of asymmetric tufts having first tuft portions with greater pile heights than their corresponding second tuft portions, a yarn is inserted into the backing via the hollow needle. As the needle rises from the backing, the backing shifts right (tufting advancing to the left) and continues forward. As the needle begins the down stroke, the back stitch is generated, back robbing occurs, and a long yarn feed begins. After a small portion of the long yarn feed is made, the cut is made, thereby forming (a) the second tuft portion of the first tuft (the height equaling the distance between the backing and cutting edge of the knife, with the yarn from the first tuft is no longer connected to the needle or feed mechanism) and (b) a portion of the first tuft portion of the next sequential tuft. As the needle rises through the backing, a second longer portion of the long yarn feed continues forming a long tuft length as the first tuft portion of the second tuft, the backing shifts right (tufting advancing to the left) and continues forward. The needle begins the down stoke, the back stitch is generated, back robbing occurs and a long yarn feed begins. After a small portion of the long yarn feed occurs, the cut is made, forming the second tuft portion of the second tuft (the height equaling the distance between the backing and cutting edge of the knife, with the yarn from the first tuft no longer being connected to the needle or feed mechanism) and a portion of the first tuft portion of the next sequential tuft. As the needle rises from the backing, a second longer portion of the long yarn feed continues forming a long tuft length as the first tuft portion of the next sequential tuft. The process continues for this yarn until the next "color/yarn exchange" occurs.

Another exemplary tufting method is described below with reference to FIG. 2. As stated in the figure, backing motion is to the left of the page, with tufting advancing to the right of the page. During generation of symmetrical tufts, a yarn is inserted into the backing via the hollow needle, the needle rises from the backing and the backing shifts right and continues forward. As the needle begins its down stroke, the back stitch is generated, back robbing occurs, and a short yarn feed begins. The cut is completed, thereby forming the second tuft portion of the first tuft (the height equaling the distance between the backing/bedplate and cutting edge of the knife, with the yarn from the first tuft no longer being connected to the needle or feed mechanism). The yarn feed ends, and the first tuft portion of the next sequential tuft is generated. As the needle rises from the backing, the backing shifts right and continues forward. As the needle begins the down stroke, the back stitch is generated, back robbing occurs and a short yarn feed begins. The cut is completed, thereby forming the second tuft portion of the second tuft (the height equaling the distance between the backing/bedplate and cutting edge of the knife, with the yarn from the second tuft no longer being connected to the needle or feed mechanism). The yarn feed ends, and the first tuft portion of the next sequential tuft is generated. This process can continue for this yarn until the next "color/yarn exchange" occurs.

During generation of asymmetric tufts having second tuft portions with greater pile heights than their corresponding first tuft portions, the yarn is inserted into the backing via the hollow needle. As the needle rises from the backing, the backing shifts right (tufting advancing to the left) and continues forward. As the needle begins the down stroke, a long yarn feed begins as the back stitch is made forming the first tuft portion. A long portion of the long yarn feed is fed before the cut is made. In exemplary aspects, the main shaft of the tufting machine can be greatly slowed from conventional operational speeds to create a long delay between the start of the yarn feed and the cut. The needle then strikes the blade and the cut is made. After the yarn is cut, the long portion of the long yarn feed that was fed before the cut straightens, making the second tuft portion of the first tuft the longer tuft portion of the tuft, and the yarn is disconnected from the needle and yarn feed mechanism. A small portion of the long yarn feed continues creating the first tuft portion of the next sequential tuft (the height equaling the distance between the backing and cutting edge of the knife). The needle rises through the backing and begins the down stroke, and a long yarn feed begins as the back stitch is made forming the next sequential tuft. A long portion of the long yarn feed is fed before the cut is made. The needle strikes the blade and the cut is made. After the yarn is cut, the long portion of the long yarn feed that was fed before the cut straightens, making the second tuft portion of the next sequential tuft the longer tuft portion of the tuft, and the yarn is disconnected from the needle and yarn feed mechanism. A small portion of the long yarn feed continues creating the first tuft portion of the next sequential tuft (the height equaling the distance between the backing and cutting edge of the knife). The process continues for this yarn until the next "color/yarn exchange" occurs.

Another exemplary tufting method is described below with reference to FIG. 3. In exemplary aspects, the at least one processor can be configured to modify the parameters of the yarn feed assembly to feed more yarn during insertion than is typically done during a continuous tufting operation, thereby causing yarn to be inserted well beyond (after) cutting action has occurred and ensuring that the yarns are not cut upon insertion. In these aspects, it is contemplated that asymmetric tufts can be maintained at the first tuft of a "color/yarn exchange" by displacing and keeping portions of the first tuft away from the "cutting zone" during a continuing tufting process. As shown in FIG. 9, the yarns can be displaced from the cutting zone via an air manifold, air injectors and/or the like or a combination air manifolds/injectors and/or variations of pressurized air supply means, to thereby prevent the inserted "long" tuft portion of the asymmetric tufts from being cut or removed from the tufted article. In contrast to conventional methods, the asymmetric tufts are maintained on the article throughout the finishing processes and are not removed via shearing. During generation of such asymmetric tufts, yarn can be inserted into the backing via the hollow needle well past the cutting action, and an extra amount of yarn is fed into the needle upon the insertion, thereby generating a "long" first tuft portion. The needle rises from the backing and the backing shifts right (tufting left) and continues forward. As the needle begins the down stroke, the back stitch is generated, back robbing occurs, and the normal yarn feed begins. The cut of the yarn is made, making the second tuft portion of the first tuft (the height equaling the distance between the backing/bedplate and cutting edge of the knife, with the yarn from the first tuft no longer being connected to the needle or feed mechanism). The feed ends, and the first tuft portion of the second tuft is generated. As the needle rises from the backing, the backing shifts right (tufting advancing to the left) and continues forward. As the needle begins the down stroke, the back stitch is generated, back robbing occurs and a short yarn feed begins. The cut is made, making the second tuft portion of the second tuft (the height equaling the distance between the backing/bedplate and cutting edge of the knife, with the yarn from the second tuft no longer being connected to the needle or feed mechanism). The feed ends, and the first tuft portion of the next sequential tuft is formed. The process continues for this yarn until the next "color/yarn exchange" occurs, at which point another asymmetric tuft can be generated.

Exemplary Applications

In some exemplary aspects, it is contemplated that the disclosed tufted articles can have tufts comprising yarn materials that are sufficient for use in conventional flooring applications (e.g., carpets, carpet tiles, rugs, mats, and the like). Optionally, each tuft of yarn materials for use in conventional flooring applications can comprise a polyamide, a polyolefin, a polyester, or combinations thereof. The term "polyamide," as utilized herein, is defined to be any long-chain polymer in which the linking functional groups are amide (—CO—NH—) linkages. The term polyamide is further defined to include copolymers, terpolymers and the like as well as homopolymers and also includes blends of two or more polyamides. In some aspects, at least one yarn tuft can comprise one or more of nylon 6, nylon 66, nylon 10, nylon 612, nylon 12, nylon 11, or any combination thereof. In other aspects, at least one yarn tuft can comprise nylon 6 or nylon 66. In yet other aspect, at least one yarn tuft can comprise nylon 6. In a yet further aspect, at least one yarn tuft can comprise nylon 66.

In some aspects, at least one yarn tuft can comprise a polyester. The term "polyester fiber" as utilized herein, includes a manufactured fiber in which the fiber forming substance is any long-chain synthetic polymer composed of at least 85% by weight of an ester of a substituted aromatic carboxylic acid, including but not restricted to substituted terephthalic units, $p(—R—O—CO—C_6H_4—CO—O—)_x$ and parasubstituted hydroxy-benzoate units, $p(—R—O—CO—C_6H_4—O—)_x$. In some aspects, at least one yarn tuft can comprise polyethylene terephthalate (PET) homopolymers and copolymers, polybutylene terephthalate (PBT) homopolymers and copolymers, and the like, including those that contain comonomers such as cyclohexanedimethanol, cyclohexanedicarboxylic acid, and the like.

In still further aspects, at least one yarn tuft can comprise polyolefin. As defined herein, the term "polyolefin" includes any class of polymers produced from a simple olefin (also called an alkene with the general formula $C_nH_{2n}$) as a monomer. In some aspects, the polyolefins which can be used to produce the yarn and fibers include, but are not limited to, polyethylene, polypropylene, both homopolymer and copolymers, poly(l-butene), poly(3-methyl-1-butene), poly(4-methyl-1-pentene) and the like, as well as combinations or mixtures of two or more of the foregoing. In certain aspects, at least one yarn tuft can comprise polyethylene or polypropylene. In other aspects, at least one yarn tuft can comprise polyethylene. In yet other aspects, at least one yarn tuft can comprise polypropylene.

In yet a further aspect, it is contemplated that the yarn tufts can comprise natural fibers, acrylics, viscose, rayon, cellulose acetate, linen, silk, cotton, wool, or any combination thereof.

As will be understood by one of ordinary skill in the art, the yarn tufts can further comprise any type or form of fiber. For example, and without limitation, the yarn tufts can comprise staple fibers or bulked continuous filament fibers.

In other exemplary aspects, it is contemplated that the disclosed tufted articles can have tufts comprising synthetic turf fibers, which are well-known in the art. Optionally, each tuft of synthetic turf fiber can comprise a material selected from the group comprising LDPE, MDPE, Nylon, PP, PET, PLA and co-extruded biomaterials thereof. In use, it is contemplated that tufted articles comprising synthetic turf fibers can be used as athletic or sport surfaces and in other applications outside conventional flooring applications.

Exemplary Aspects

In view of the described systems and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1. A tufted article comprising: a backing material having a face surface and an opposed back surface; and a plurality of cut tufts, wherein each cut tuft of the plurality of cut tufts comprises: first and second tuft portions projecting from the face surface of the backing material, wherein the first and second tuft portions have respective pile heights relative to the backing material; and a backstitch that joins the first and second tuft portions and extends across a portion of the back surface of the backing material, wherein the plurality of cut tufts comprise: a plurality of asymmetric tufts that have first and second tuft portions with unequal pile heights; and at least one symmetrical tuft having first and second tuft portions with substantially equal pile heights, wherein the first and second tuft portions of the at least one symmetrical tuft cooperate with the first and second tuft portions of the plurality of asymmetric tufts to define the face pattern of the tufted article, and wherein the pile height of the first tuft portion of each asymmetric tuft is greater than the pile heights of the first and second tuft portions of the at least one symmetrical tuft.

Aspect 2. The tufted article of aspect 1, wherein the first and second tuft portions and the backstitch of each tuft have respective lengths, and wherein each tuft has a total tuft length equal to the sum of the lengths of the first and second tuft portions and the backstitch of the tuft, and wherein each of the asymmetric tufts has substantially the same total tuft length.

Aspect 3. The tufted article of aspect 1, wherein the first and second tuft portions and the backstitch of each tuft have respective lengths, and wherein each tuft has a total tuft length equal to the sum of the lengths of the first and second tuft portions and the backstitch of the tuft, wherein at least one asymmetric tuft of the plurality of asymmetric tuft has a different total tuft length than at least one other asymmetric tuft of the plurality of asymmetric tufts.

Aspect 4. The tufted article of aspect 1, wherein the first and second tuft portions and the backstitch of each tuft have respective lengths, and wherein each tuft has a total tuft length equal to the sum of the lengths of the first and second tuft portions and the backstitch of the tuft, and wherein at least one asymmetric tuft of the plurality of asymmetric tufts has a different total tuft length than at least two other asymmetric tufts of the plurality of asymmetric tufts.

Aspect 5. The tufted article of any one of the preceding aspects, wherein the pile height of the first tuft portion of each asymmetric tuft is greater than the pile height of the second tuft portion of the asymmetric tuft, wherein the pile height of the first tuft portion of each asymmetric tuft ranges from about 0.25 to about 3.0 inches, and wherein the pile height of the second tuft portion of the asymmetric tuft ranges from about 0.125 to about 0.375 inches.

Aspect 6. The tufted article of aspect 5, wherein the pile height of the first tuft portion of each asymmetric tuft ranges from about 0.50 to about 2.0 inches.

Aspect 7. The tufted article of aspect 5, wherein the pile height of the first tuft portion of each asymmetric tuft ranges from about 0.75 to about 1.5 inches.

Aspect 8. The tufted article of aspect 5, wherein the first and second tuft portions and the backstitch of each tuft have respective lengths, and wherein each tuft has a total tuft length equal to the sum of the lengths of the first and second tuft portions and the backstitch of the tuft, and wherein the total tuft length of each asymmetric tuft of the plurality of asymmetric tufts is greater than the total tuft length of each symmetrical tuft of the at least one symmetrical tuft.

Aspect 9. The tufted article of any one of the preceding aspects, wherein the pile height of the second tuft portion of each asymmetric tuft is substantially equal to the pile heights of the first and second tuft portions of the at least one symmetrical tuft.

Aspect 10. The tufted article of any one of the preceding aspects, wherein a ratio between the pile height of the first tuft portion of each asymmetric tuft and the pile height of the second tuft portion of the asymmetric tuft ranges from about 1.5 to about 24.

Aspect 11. The tufted article of aspect 10, wherein the ratio between the pile height of the first tuft portion of each asymmetric tuft and the pile height of the second tuft portion of the asymmetric tuft ranges from about 2 to about 16.

Aspect 12. The tufted article of aspect 10, wherein the ratio between the pile height of the first tuft portion of each asymmetric tuft and the pile height of the second tuft portion of the asymmetric tuft ranges from about 3 to about 12.

Aspect 13. The tufted article of aspect 10, wherein the first and second tuft portions and the backstitch of each tuft have respective lengths, wherein each tuft has a total tuft length equal to the sum of the lengths of the first and second tuft portions and the backstitch of the tuft, and wherein the total tuft length of each asymmetric tuft of the plurality of asymmetric tufts is greater than the total tuft length of each symmetrical tuft of the at least one symmetrical tuft.

Aspect 14. The tufted article of any one of aspects 10-13, wherein the pile height of the second tuft portion of each asymmetric tuft is substantially equal to the pile heights of the first and second tuft portions of the at least one symmetrical tuft.

Aspect 15. The tufted article of any one of the preceding aspects, wherein the plurality of tufts comprise at least one loop tuft.

Aspect 16. A system for controlling the tufting of a patterned tufted article, the system comprising: a bed plate configured to support a backing material; a roll assembly configured to drive movement of the backing material; a hollow needle having an inlet and an outlet; a yarn feed assembly having an inlet and an outlet positioned in communication with the inlet of the hollow needle, wherein the yarn feed assembly is configured to direct yarn to the hollow needle during a yarn feed cycle; a needle actuation assembly configured to drive sequential strokes of reciprocal movement of the hollow needle relative to a tufting axis to penetrate the backing material and position sequential tufts of yarn through the backing material, wherein the needle actuation assembly comprises a main shaft coupled to the hollow needle such that rotational movement of the main shaft imparts corresponding reciprocal movement of the hollow needle; a cutting assembly configured to cut the sequential tuft of yarns to form first and second tuft portions of each tuft that project from a face surface of the backing material and are joined by a backstitch of the tuft, wherein the cutting assembly is configured to cut the sequential tufts of yarn at a fixed cutting location to produce a second tuft portion of a tuft and define a start of a first tuft portion of the next sequential tuft, and wherein the distance between the fixed cutting location and the bed plate relative to the tufting axis is fixed during tufting; and at least one processor communicatively coupled to the yarn feed assembly and the cutting assembly, wherein during at least one selected stroke of the needle actuation assembly the at least one processor is configured to: selectively direct the cutting assembly to effect cutting of a tuft formed by the hollow needle at a selected cut time, wherein the selected cut time corresponds to a first selected rotational position of the main shaft; and selectively activate the yarn feed assembly during a corresponding yarn feed cycle to deliver selected percentages of a yarn feed before and after the selected cut time to thereby produce a second tuft portion having a pile height that is different than a pile height of the first tuft portion of the tuft.

Aspect 17. The system of aspect 16, wherein the first selected rotational position of the main shaft is offset from a halfway point of a halfway point of a corresponding yarn feed cycle.

Aspect 18. The system of aspect 17, wherein the first selected rotational position of the main shaft occurs before the halfway point of the corresponding yarn feed cycle.

Aspect 19. The system of aspect 18, wherein the first selected rotational position of the main shaft ranges from about 120 degrees to about 180 degrees.

Aspect 20. The system of aspect 19, wherein the first selected rotational position of the main shaft is about 165 degrees.

Aspect 21. The system of aspect 19 or aspect 20, wherein, during the at least one selected stroke of the needle actuation assembly, the at least one processor is configured to deliver a first percentage of the yarn feed to the needle before the selected cut time and to deliver a second percentage of the yarn feed to the needle after the selected cut time, wherein the first percentage of the yarn feed is less than the second percentage of the yarn feed in both duration and length.

Aspect 22. The system of aspect 21, wherein the first percentage ranges from about 10 percent to about 45 percent, and wherein the second percentage ranges from about 55 percent to about 90 percent.

Aspect 23. The system of aspect 22, wherein the first percentage ranges from about 35 to about 40 percent, and wherein the second percentage ranges from about 60 percent to about 65 percent.

Aspect 24. The system of any one of aspects 21-23, wherein, for each selected stroke of the needle actuation assembly, the at least one processor is configured to selectively direct the yarn feed assembly to begin feeding yarn to the hollow needle at a feed start time that corresponds to a second selected rotational position of the main shaft, and wherein the second selected rotational position of the main shaft ranges from about 15 degrees to about 150 degrees.

Aspect 25. The system of aspect 24, wherein the second selected rotational position ranges from about 100 degrees to about 140 degrees.

Aspect 26. The system of aspect 24 or aspect 25, wherein, for each selected stroke of the needle actuation assembly, the at least one processor is configured to selectively direct the yarn feed assembly to stop feeding yarn to the hollow needle at a feed stop time that corresponds to a third selected rotational position of the main shaft, and wherein the third selected rotational position of the main shaft ranges from about 100 degrees to about 300 degrees.

Aspect 27. The system of aspect 26, wherein the third selected rotational position ranges from about 200 degrees to about 300 degrees.

Aspect 28. The system of any one of aspects 21-27, wherein, for each selected stroke of the needle actuation assembly, the at least one processor is configured to selectively direct the yarn feed assembly to begin feeding yarn to the hollow needle at a feed start time that corresponds to a second selected rotational position of the main shaft and to selectively direct the yarn feed assembly to stop feeding yarn to the hollow needle at a feed stop time that corresponds to a third selected rotational position of the main shaft, wherein the angular difference between the second and third selected rotational positions ranges from about 50 degrees to about 170 degrees.

Aspect 29. The system of any one of aspects 16-28, wherein during at least one stroke of the needle actuation assembly, the processor is configured to selectively control the yarn feed assembly and the cutting assembly to produce a symmetrical tuft having first and second tuft portions with substantially equal pile heights relative to the backing material.

Aspect 30. The system of aspect 29, wherein, during the at least one selected stroke of the needle actuation assembly, the processor is configured to provide yarn to the needle assembly at a selected yarn feed rate that is greater than a yarn feed rate used to produce the symmetrical tuft.

Aspect 31. The system of aspect 30, wherein during the at least one stroke of the needle actuation assembly that produces a symmetrical tuft, the at least one processor is configured to: selectively direct the cutting assembly to effect cutting of a tuft formed by the hollow needle at a selected cut time; and selectively activate the yarn feed assembly during a corresponding yarn feed cycle to deliver a first percentage of the yarn feed to the needle before the selected cut time and to deliver a second percentage of the yarn feed to the needle after the selected cut time, wherein the first percentage of the yarn feed is greater than the second percentage of the yarn feed in both duration and length.

Aspect 32. The system of aspect 31, wherein the second percentage of the yarn feed for producing the symmetrical tuft ranges from about 5 percent to about 45 percent, and wherein the first percentage of the yarn feed for producing the symmetrical tuft ranges from about 55 percent to about 95 percent.

Aspect 33. The system of aspect 32, wherein the second percentage of the yarn feed for producing the symmetrical tuft is about 10 percent, and wherein the first percentage of the yarn feed for producing the symmetrical tuft is about 90 percent.

Aspect 34. The system of any one of aspects 31-33, wherein during the at least one stroke of the needle actuation assembly that produces a symmetrical tuft, the selected cut time corresponds to the first selected rotational position of the main shaft.

Aspect 35. The system of any one of aspects 31-33, wherein during the at least one stroke of the needle actuation assembly that produces a symmetrical tuft, the selected cut time corresponds to a rotational position of the main shaft different from the first selected rotational position of the main shaft.

Aspect 36. The system of any one of aspects 32-35, wherein, for each stroke of the needle actuation assembly that produces a symmetrical tuft, the at least one processor is configured to selectively direct the yarn feed assembly to begin feeding yarn to the hollow needle at a feed start time that corresponds to a rotational position of the main shaft ranging from about 15 degrees to about 150 degrees.

Aspect 37. The system of aspect 36, wherein, for each stroke of the needle actuation assembly that produces a symmetrical tuft, the at least one processor is configured to selectively direct the yarn feed assembly to stop feeding yarn to the hollow needle at a feed stop time that corresponds to a rotational position of the main shaft ranging from about 100 degrees to about 300 degrees.

Aspect 38. The system of any one of aspects 16-37, wherein the yarn feed assembly comprises at least one air cylinder configured to deliver yarn to the hollow needle.

Aspect 39. The system of any one of aspects 16-37, wherein the yarn feed assembly comprises at least one servo motor configured to deliver yarn to the hollow needle.

Aspect 40. The system of any one of aspects 16-39, further comprising an air delivery assembly, wherein the air delivery assembly is configured to provide positive air pressure proximate each tuft to displace portions of the tuft relative to the fixed cutting location.

Aspect 41. The system of any one of aspects 16-40, wherein the cutting assembly is a knife assembly.

Aspect 42. The system of any one of aspects 16-40, wherein the cutting assembly is a cut and loop assembly, and wherein during at least one stroke of the needle actuation assembly, the at least one processor is configured to selectively control the yarn feed assembly and the cutting assembly to produce a loop tuft.

Aspect 43. A method for controlling the tufting of a patterned tufted article, the method comprising: supporting a backing material on a bed plate; using a yarn feed assembly to direct yarn to a hollow needle during a yarn feed cycle, the yarn feed assembly being communicatively coupled to at least one processor; using a needle actuation assembly to drive sequential strokes of reciprocal movement of the hollow needle relative to a tufting axis to penetrate the backing material and position sequential tufts of yarn within the backing material, wherein the needle actuation assembly comprises a main shaft that is coupled to the hollow needle such that rotational movement of the main shaft imparts corresponding reciprocal movement of the hollow needle; and using a cutting assembly to cut the sequential tufts of yarn to form first and second tuft portions of each tuft that project from the face surface of the backing material and are joined by a backstitch of the tuft, the cutting assembly being communicatively coupled to the at least one processor, wherein the cutting assembly cuts the sequential tufts of yarn at a fixed cutting location to produce a second tuft portion of a tuft and define a start of a first tuft portion of the next sequential tuft, and wherein the distance between the fixed cutting location and the bed plate relative to the tufting axis is fixed during tufting; and during at least one selected stroke of the needle actuation assembly, using the at least one processor to: direct the cutting assembly to effect cutting of a tuft formed by the hollow needle at a selected cut time that corresponds to a first selected rotational position of the main shaft; and selectively activate the yarn feed assembly during a corresponding yarn feed cycle to deliver selected percentages of a yarn feed before and after the selected cut time to thereby produce a second tuft portion having a pile height that is different than a pile height of the first tuft portion of the tuft.

Aspect 44. The method of aspect 43, wherein the first selected rotational position of the main shaft is offset from a halfway point of a corresponding yarn feed cycle.

Aspect 45. The method of aspect 44, wherein the first selected rotational position of the main shaft occurs before the halfway point of the corresponding yarn feed cycle.

Aspect 46. The method of aspect 44 or aspect 45, wherein the first selected rotational position of the main shaft ranges from about 120 degrees to about 180 degrees.

Aspect 47. The method of aspect 46, wherein the first selected rotational position of the main shaft is about 165 degrees.

Aspect 48. The method of aspect 46 or aspect 47, wherein, during the at least one selected stroke of the needle actuation assembly, the yarn feed assembly delivers a first percentage of the yarn feed to the needle before the selected cut time and delivers a second percentage of the yarn feed to the needle after the selected cut time, wherein the first percentage of the yarn feed is less than the second percentage of the yarn feed in both duration and length.

Aspect 49. The method of aspect 47 or aspect 48, wherein the first percentage ranges from about 10 percent to about 45 percent, and wherein the second percentage ranges from about 55 percent to about 90 percent.

Aspect 50. The method of aspect 49, wherein the first percentage is about 40 percent, and wherein the second percentage is about 60 percent.

Aspect 51. The method of any one of aspects 48-50, wherein, for each selected stroke of the needle actuation assembly, the at least one processor selectively directs the yarn feed assembly to begin feeding yarn to the hollow needle at a feed start time that corresponds to a second selected rotational position of the main shaft, and wherein the second selected rotational position of the main shaft ranges from about 15 degrees to about 150 degrees.

Aspect 52. The method of aspect 51, wherein the second selected rotational position ranges from about 120 degrees to about 130 degrees.

Aspect 53. The method of aspect 51 or aspect 52, wherein, for each selected stroke of the needle actuation assembly, the at least one processor is configured to selectively direct the yarn feed assembly to stop feeding yarn to the hollow needle at a feed stop time that corresponds to a third selected rotational position of the main shaft, and wherein the third selected rotational position of the main shaft ranges from about 100 degrees to about 300 degrees.

Aspect 54. The method of aspect 53, wherein the third selected rotational position ranges from about 200 degrees to about 300 degrees.

Aspect 55. The method of any one of aspects 48-54, wherein, for each selected stroke of the needle actuation assembly, the at least one processor selectively directs the yarn feed assembly to begin feeding yarn to the hollow needle at a feed start time that corresponds to a second selected rotational position of the main shaft and selectively directs the yarn feed assembly to stop feeding yarn to the hollow needle at a feed stop time that corresponds to a third selected rotational position of the main shaft, wherein the angular difference between the second and third selected rotational positions ranges from about 50 degrees to about 170 degrees.

Aspect 56. The method of any one of aspects 43-55, wherein during at least one stroke of the needle actuation assembly, the processor selectively controls the yarn feed assembly and the cutting assembly to produce a symmetrical tuft having first and second tuft portions with substantially equal pile heights relative to the backing material.

Aspect 57. The method of aspect 56, wherein, during the at least one selected stroke of the needle actuation assembly, the processor provides yarn to the needle assembly at a selected yarn feed rate that is greater than a yarn feed rate used to produce the symmetrical tuft.

Aspect 58. The method of aspect 57, wherein during the at least one stroke of the needle actuation assembly that produces a symmetrical tuft, the at least one processor: selectively directs the cutting assembly to effect cutting of a tuft formed by the hollow needle at a selected cut time; and selectively activates the yarn feed assembly during a corresponding yarn feed cycle to deliver a first percentage of the yarn feed to the needle before the selected cut time and to deliver a second percentage of the yarn feed to the needle after the selected cut time, wherein the first percentage of the yarn feed is greater than the second percentage of the yarn feed in both duration and length.

Aspect 59. The method of aspect 58, wherein the second percentage of the yarn feed for producing the symmetrical tuft ranges from about 5 percent to about 45 percent, and wherein the first percentage of the yarn feed for producing the symmetrical tuft ranges from about 55 percent to about 95 percent.

Aspect 60. The method of aspect 59, wherein the second percentage of the yarn feed for producing the symmetrical tuft is about 10 percent, and wherein the first percentage of the yarn feed for producing the symmetrical tuft is about 90 percent.

Aspect 61. The method of any one of aspects 58-60, wherein during the at least one stroke of the needle actuation assembly that produces a symmetrical tuft, the selected cut time corresponds to the first selected rotational position of the main shaft.

Aspect 62. The method of any one of aspects 58-60, wherein during the at least one stroke of the needle actuation assembly that produces a symmetrical tuft, the selected cut time corresponds to a rotational position of the main shaft different from the first selected rotational position of the main shaft.

Aspect 63. The method of aspects 59-62, wherein, for each stroke of the needle actuation assembly that produces a symmetrical tuft, the at least one processor selectively directs the yarn feed assembly to begin feeding yarn to the hollow needle at a feed start time that corresponds to a rotational position of the main shaft ranging from about 15 degrees to about 150 degrees.

Aspect 64. The method of aspect 63, wherein, for each stroke of the needle actuation assembly that produces a symmetrical tuft, the at least one processor selectively directs the yarn feed assembly to stop feeding yarn to the hollow needle at a feed stop time that corresponds to a rotational position of the main shaft ranging from about 100 degrees to about 300 degrees.

Aspect 65. The method of any one of aspects 43-64, wherein the yarn feed assembly comprises at least one air cylinder that delivers yarn to the hollow needle.

Aspect 66. The method of any one of aspects 43-64, wherein the yarn feed assembly comprises at least one servo motor that delivers yarn to the hollow needle.

Aspect 67. The method of any one of aspects 43-66, further comprising during the at least one selected stroke of the needle actuation assembly, directing an air delivery assembly to provide positive air pressure proximate each tuft and displace the second tuft portion of the tuft relative to the fixed cutting location.

Aspect 68. The method of any one of aspects 43-67, wherein the distance between the fixed cutting location and the bed plate relative to the tufting axis ranges from about 0.1 to about 3.0 inches.

Aspect 69. The method of any one of aspects 43-67, wherein the distance between the fixed cutting location and the bed plate relative to the tufting axis ranges from about 0.1 to about 0.8 inches.

Aspect 70. The method of any one of aspects 43-69, wherein during each stroke of the needle actuation assembly following a selected stroke of the needle actuation assembly, the needle back-robs portions of yarn fed following the cutting of a preceding tuft of yarn, wherein the back-robbed portions of yarn form the back stitch, the second tuft portion of the corresponding tuft, and a portion of the first tuft portion of the next sequential tuft of yarn.

Aspect 71. The method of aspect 70, wherein the pile height of the first tuft portion produced during a selected stroke of the needle actuation assembly ranges from about 0.25 to about 3 inches, and wherein the pile height of the second tuft portion produced during a selected stroke of the needle actuation assembly ranges from about 0.125 to about 0.375 inches.

Aspect 72. The method of aspect 70 or aspect 71, wherein the pile height of the first tuft portion produced during a selected stroke of the needle actuation assembly ranges from about 0.125 to about 0.375 inches, and wherein the pile height of the second tuft portion produced during a selected stroke of the needle actuation assembly ranges from about 0.25 to about 3 inches.

Aspect 73. The method of aspect 71 or aspect 72, wherein at least one stroke of the needle actuation assembly produces a symmetrical tuft with first and second tuft portions having substantially equal pile heights, and wherein the tufts formed during the at least one selected stroke of the needle actuation assembly cooperate with the symmetrical tufts to form a pattern of the patterned tufted article.

Aspect 74. The method of aspect 73, wherein the pile height of the first tuft portion of each tuft produced during a selected stroke of the needle actuation assembly is greater than the pile heights of the first and second tuft portions of each symmetrical tuft.

Aspect 75. The method of any one of aspects 43-74, further comprising, between sequential strokes of the needle actuation assembly, advancing the backing material relative to an axis that is perpendicular to the tufting axis.

Aspect 76. The method of any one of aspects 43-75, wherein the method does not comprise adjusting the pile heights of the first and second tuft portions of each tuft formed during a selected stroke of the needle actuation assembly.

Aspect 77. The method of any one of aspects 43-76, wherein the cutting assembly is a knife assembly.

Aspect 78. The method of any one of aspects 43-77, wherein the cutting assembly is a cut and loop assembly, and wherein during at least one stroke of the needle actuation assembly, the at least one processor selectively controls the yarn feed assembly and the cutting assembly to produce a loop tuft.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A tufted article comprising:

a backing material having a face surface and an opposed back surface, wherein the backing material comprises a plurality of openings formed through the backing material from the back surface to the face surface; and a plurality of cut tufts, wherein each cut tuft of the plurality of cut tufts comprises:

first and second tuft portions extending through respective openings of the backing material and projecting from the face surface of the backing material, wherein the first and second tuft portions have respective pile heights relative to the backing material; and a backstitch that joins the first and second tuft portions and extends across a portion of the back surface between the respective openings of the backing material, wherein the plurality of cut tufts comprise:

a plurality of asymmetric tufts that have first and second tuft portions with unequal pile heights; and at least one symmetrical tuft having first and second tuft portions with substantially equal pile heights, wherein the first and second tuft portions of the at least one symmetrical tuft cooperate with the first and second tuft portions of the plurality of asymmetric tufts to define the face pattern of the tufted article, and wherein the pile height of the first tuft portion of each asymmetric tuft is greater than the pile heights of the first and second tuft portions of the at least one symmetrical tuft, wherein the pile height of the second tuft portion of each asymmetric tuft is substantially equal to the pile heights of the first and second tuft portions of the at least one symmetrical tuft.

2. The tufted article of claim 1, wherein the first and second tuft portions and the backstitch of each tuft have respective lengths, and wherein each tuft has a total tuft length equal to the sum of the lengths of the first and second tuft portions and the backstitch of the tuft, and wherein each of the asymmetric tufts has substantially the same total tuft length.

3. The tufted article of claim 1, wherein the first and second tuft portions and the backstitch of each tuft have respective lengths, and wherein each tuft has a total tuft length equal to the sum of the lengths of the first and second tuft portions and the backstitch of the tuft, wherein at least one asymmetric tuft of the plurality of asymmetric tuft has a different total tuft length than at least one other asymmetric tuft of the plurality of asymmetric tufts.

4. The tufted article of claim 1, wherein the first and second tuft portions and the backstitch of each tuft have respective lengths, and wherein each tuft has a total tuft length equal to the sum of the lengths of the first and second tuft portions and the backstitch of the tuft, and wherein at least one asymmetric tuft of the plurality of asymmetric tufts has a different total tuft length than at least two other asymmetric tufts of the plurality of asymmetric tufts.

5. The tufted article of claim 1, wherein the pile height of the first tuft portion of each asymmetric tuft is greater than the pile height of the second tuft portion of the asymmetric tuft, wherein the pile height of the first tuft portion of each asymmetric tuft ranges from about 0.25 to about 3.0 inches, and wherein the pile height of the second tuft portion of the asymmetric tuft ranges from about 0.125 to about 0.375 inches.

6. The tufted article of claim 5, wherein the pile height of the first tuft portion of each asymmetric tuft ranges from about 0.50 to about 2.0 inches.

7. The tufted article of claim 5, wherein the pile height of the first tuft portion of each asymmetric tuft ranges from about 0.75 to about 1.5 inches.

8. The tufted article of claim 5, wherein the first and second tuft portions and the backstitch of each tuft have respective lengths, and wherein each tuft has a total tuft length equal to the sum of the lengths of the first and second tuft portions and the backstitch of the tuft, and wherein the total tuft length of each asymmetric tuft of the plurality of asymmetric tufts is greater than the total tuft length of each symmetrical tuft of the at least one symmetrical tuft.

9. The tufted article of claim 1, wherein a ratio between the pile height of the first tuft portion of each asymmetric tuft and the pile height of the second tuft portion of the asymmetric tuft ranges from about 1.5 to about 24.

10. The tufted article of claim 9, wherein the ratio between the pile height of the first tuft portion of each asymmetric tuft and the pile height of the second tuft portion of the asymmetric tuft ranges from about 2 to about 16.

11. The tufted article of claim 9, wherein the ratio between the pile height of the first tuft portion of each asymmetric tuft and the pile height of the second tuft portion of the asymmetric tuft ranges from about 3 to about 12.

12. The tufted article of claim 9, wherein the first and second tuft portions and the backstitch of each tuft have respective lengths, wherein each tuft has a total tuft length equal to the sum of the lengths of the first and second tuft portions and the backstitch of the tuft, and wherein the total tuft length of each asymmetric tuft of the plurality of asymmetric tufts is greater than the total tuft length of each symmetrical tuft of the at least one symmetrical tuft.

13. The tufted article of claim 9, wherein the pile height of the second tuft portion of each asymmetric tuft is substantially equal to the pile heights of the first and second tuft portions of the at least one symmetrical tuft.

14. The tufted article of claim 1, wherein the plurality of tufts comprise at least one loop tuft.

15. The tufted article of claim 1, wherein the plurality of cut tufts are positioned within a single row of tufts, wherein the row of tufts comprises a plurality of sequential, evenly spaced tufts of a single yarn.

16. A tufted article comprising:

a backing material having a face surface and an opposed back surface, wherein the backing material comprises a plurality of openings formed through the backing material from the back surface to the face surface; and a plurality of cut tufts, wherein each cut tuft of the plurality of cut tufts comprises:

first and second tuft portions extending through respective openings of the backing material and projecting from the face surface of the backing material, wherein the first and second tuft portions have respective pile heights relative to the backing material; and a backstitch that joins the first and second tuft portions and extends across a portion of the back surface between the respective openings of the backing material, wherein the plurality of cut tufts comprise:

a plurality of asymmetric tufts that have first and second tuft portions with unequal pile heights; and at least one symmetrical tuft having first and second tuft portions with substantially equal pile heights, wherein the first and second tuft portions of the at least one symmetrical tuft cooperate with the first and second tuft portions of the plurality of asymmetric tufts to define the face pattern of the tufted article, wherein the pile height of the first tuft portion of each asymmetric tuft is greater than the pile heights of the first and second tuft portions of the at least one symmetrical tuft, wherein the first and second tuft portions and the backstitch of each tuft have respective lengths, and wherein each tuft has a total tuft length equal to the sum of the lengths of the first and second tuft portions and the backstitch of the tuft, and wherein each of the asymmetric tufts has substantially the same total tuft length.

17. A tufted article comprising:

a backing material having a face surface and an opposed back surface, wherein the backing material comprises a plurality of openings formed through the backing material from the back surface to the face surface; and a plurality of cut tufts, wherein each cut tuft of the plurality of cut tufts comprises:

first and second tuft portions extending through respective openings of the backing material and projecting from the face surface of the backing material, wherein the first and second tuft portions have respective pile heights relative to the backing material; and a backstitch that joins the first and second tuft portions and extends across a portion of the back surface between the respective openings of the backing material, wherein the plurality of cut tufts comprise:

a plurality of asymmetric tufts that have first and second tuft portions with unequal pile heights; and at least one symmetrical tuft having first and second tuft portions with substantially equal pile heights, wherein the first and second tuft portions of the at least one symmetrical tuft cooperate with the first and second tuft portions of the plurality of asymmetric tufts to define the face pattern of the tufted article, wherein the pile height of the first tuft portion of each asymmetric tuft is greater than the pile heights of the first and second tuft portions of the at least one symmetrical tuft, and wherein the first and second tuft portions and the backstitch of each tuft have respective lengths, and wherein each tuft has a total tuft length equal to the sum of the lengths of the first and second tuft portions and the backstitch of the tuft, wherein at least one asymmetric tuft of the plurality of asymmetric tuft has a different total tuft length than at least one other asymmetric tuft of the plurality of asymmetric tufts.

18. A tufted article comprising:

a backing material having a face surface and an opposed back surface, wherein the backing material comprises a plurality of openings formed through the backing material from the back surface to the face surface; and a plurality of cut tufts, wherein each cut tuft of the plurality of cut tufts comprises:

first and second tuft portions extending through respective openings of the backing material and projecting from the face surface of the backing material, wherein the first and second tuft portions have respective pile heights relative to the backing material; and a backstitch that joins the first and second tuft portions and extends across a portion of the back surface between the respective openings of the backing material, wherein the plurality of cut tufts comprise:

a plurality of asymmetric tufts that have first and second tuft portions with unequal pile heights; and at least one symmetrical tuft having first and second tuft portions with substantially equal pile heights, wherein the first and second tuft portions of the at least one symmetrical tuft cooperate with the first and second tuft portions of the plurality of asymmetric tufts to define the face pattern of the tufted article, wherein the pile height of the first tuft portion of each asymmetric tuft is greater than the pile heights of the first and second tuft portions of the at least one symmetrical tuft, wherein the first and second tuft portions and the backstitch of each tuft have respective lengths, and wherein each tuft has a total tuft length equal to the sum of the lengths of the first and second tuft portions and the backstitch of the tuft, and wherein at least one asymmetric tuft of the plurality of asymmetric tufts has a different total tuft length than at least two other asymmetric tufts of the plurality of asymmetric tufts.

19. A tufted article comprising:

a backing material having a face surface and an opposed back surface, wherein the backing material comprises a plurality of openings formed through the backing material from the back surface to the face surface; and a plurality of cut tufts, wherein each cut tuft of the plurality of cut tufts comprises:

first and second tuft portions extending through respective openings of the backing material and projecting from the face surface of the backing material, wherein the first and second tuft portions have respective pile heights relative to the backing material; and a backstitch that joins the first and second tuft portions and extends across a portion of the back surface between the respective openings of the backing material, wherein the plurality of cut tufts comprise:

a plurality of asymmetric tufts that have first and second tuft portions with unequal pile heights; and at least one symmetrical tuft having first and second tuft portions with substantially equal pile heights, wherein the first and second tuft portions of the at least one symmetrical tuft cooperate with the first and second tuft portions of the plurality of asymmetric tufts to define the face pattern of the tufted article, wherein the pile height of the first tuft portion of each asymmetric tuft is greater than the pile heights of the first and second tuft portions of the at least one symmetrical tuft, wherein the pile height of the first tuft portion of each asymmetric tuft is greater than the pile height of the second tuft portion of the asymmetric tuft, wherein the pile height of the first tuft portion of each asymmetric tuft ranges from about 0.25 to about 3.0 inches, and wherein the pile height of the second tuft portion of the asymmetric tuft ranges from about 0.125 to about 0.375 inches, and wherein the first and second tuft portions and the backstitch of each tuft have respective lengths, and wherein each tuft has a total tuft length equal to the sum of the lengths of the first and second tuft portions and the backstitch of the tuft, and wherein the total tuft length of each asymmetric tuft of the plurality of asymmetric tufts is greater than the total tuft length of each symmetrical tuft of the at least one symmetrical tuft.

20. A tufted article comprising:

a backing material having a face surface and an opposed back surface, wherein the backing material comprises a plurality of openings formed through the backing material from the back surface to the face surface; and a plurality of cut tufts, wherein each cut tuft of the plurality of cut tufts comprises:

first and second tuft portions extending through respective openings of the backing material and projecting from the face surface of the backing material, wherein the first and second tuft portions have respective pile heights relative to the backing material; and a backstitch that joins the first and second tuft portions and extends across a portion of the back surface between the respective openings of the backing material, wherein the plurality of cut tufts comprise:

a plurality of asymmetric tufts that have first and second tuft portions with unequal pile heights; and at least one symmetrical tuft having first and second tuft portions with substantially equal pile heights, wherein the first and second tuft portions of the at least one symmetrical tuft cooperate with the first and second tuft portions of the plurality of asymmetric tufts to define the face pattern of the tufted article, wherein the pile height of the first tuft portion of each asymmetric tuft is greater than the pile heights of the first and second tuft portions of the at least one symmetrical tuft, wherein a ratio between the pile height of the first tuft portion of each asymmetric tuft and the pile height of the second tuft portion of the asymmetric tuft ranges from about 1.5 to about 24, and wherein the first and second tuft portions and the backstitch of each tuft have respective lengths, wherein each tuft has a total tuft length equal to the sum of the lengths of the first and second tuft portions and the backstitch of the tuft, and wherein the total tuft length of each asymmetric tuft of the plurality of asymmetric tufts is greater than the total tuft length of each symmetrical tuft of the at least one symmetrical tuft.

21. A tufted article comprising:

a backing material having a face surface and an opposed back surface, wherein the backing material comprises a plurality of openings formed through the backing material from the back surface to the face surface; and a plurality of cut tufts, wherein each cut tuft of the plurality of cut tufts comprises:

first and second tuft portions extending through respective openings of the backing material and projecting from the face surface of the backing material, wherein the first and second tuft portions have respective pile heights relative to the backing material; and a backstitch that joins the first and second tuft portions and extends across a portion of the back surface between the respective openings of the backing material, wherein the plurality of cut tufts comprise:

a plurality of asymmetric tufts that have first and second tuft portions with unequal pile heights; and at least one symmetrical tuft having first and second tuft portions with substantially equal pile heights, wherein the first and second tuft portions of the at least one symmetrical tuft cooperate with the first and second tuft portions of the plurality of asymmetric tufts to define the face pattern of the tufted article, wherein the pile height of the first tuft portion of each asymmetric tuft is greater than the pile heights of the first and second tuft portions of the at least one symmetrical tuft, wherein a ratio between the pile height of the first tuft portion of each asymmetric tuft and the pile height of the second tuft portion of the asymmetric tuft ranges from about 1.5 to about 24, and wherein the pile height of the second tuft portion of each asymmetric tuft is substantially equal to the pile heights of the first and second tuft portions of the at least one symmetrical tuft.

* * * * *